US010947609B2

(12) United States Patent
YiM et al.

(10) Patent No.: US 10,947,609 B2
(45) Date of Patent: Mar. 16, 2021

(54) MAGNESIUM ALLOY HAVING EXCELLENT MECHANICAL PROPERTIES AND CORROSION RESISTANCE AND METHOD FOR MANUFACTURING THE SAME

(71) Applicant: KOREA INSTITUTE OF MACHINERY & MATERIALS, Daejeon (KR)

(72) Inventors: Chang-Dong YiM, Seoul (KR); Bong-Sun You, Changwon-si (KR); Ha-Sik Kim, Changwon-si (KR); Young-Min Kim, Daejeon (KR); Byoung-Gi Moon, Changwon-si (KR); Jun-Ho Bae, Gimhae-si (KR)

(73) Assignee: KOREA INSTITUTE OF MATERIALS SCIENCE, Changwon-Si (KR)

( * ) Notice: Subject to any disclaimer, the term of this patent is extended or adjusted under 35 U.S.C. 154(b) by 267 days.

(21) Appl. No.: 16/066,003

(22) PCT Filed: Nov. 30, 2016

(86) PCT No.: PCT/KR2016/013959
§ 371 (c)(1),
(2) Date: Jun. 25, 2018

(87) PCT Pub. No.: WO2017/116020
PCT Pub. Date: Jul. 6, 2017

(65) Prior Publication Data

US 2019/0010582 A1 Jan. 10, 2019

(30) Foreign Application Priority Data

Dec. 28, 2015 (KR) ..... 10-2015-0187878
Nov. 30, 2016 (KR) ..... 10-2016-0161445

(51) Int. Cl.
*C22C 23/06* (2006.01)
*C22C 23/02* (2006.01)
(Continued)

(52) U.S. Cl.
CPC ..... *C22C 23/06* (2013.01); *C22C 23/00* (2013.01); *C22C 23/02* (2013.01); *C22C 23/04* (2013.01); *C22F 1/06* (2013.01)

(58) Field of Classification Search
CPC . C22F 1/06; C22C 23/00; C22C 23/02; C22C 23/06; C22C 23/04
See application file for complete search history.

(56) References Cited

U.S. PATENT DOCUMENTS

2014/0044586 A1* 2/2014 Hirai ..... C22F 1/06 420/405
2014/0271333 A1 9/2014 Kim et al.
2015/0083285 A1 3/2015 Somekawa et al.

FOREIGN PATENT DOCUMENTS

CN 103882274 A 6/2014
JP 2010-13725 A 1/2010
(Continued)

OTHER PUBLICATIONS

Korean Office Action dated Dec. 14, 2017 in connection with counterpart Korean Patent Application No. 10-2016-0161445, citing the above references.
(Continued)

*Primary Examiner* — Jessee R Roe
(74) *Attorney, Agent, or Firm* — Hauptman Ham, LLP

(57) ABSTRACT

The present invention is to provide a magnesium alloy comprising 0.001 parts by weight to 1.0 parts by weight of scandium and the balance of magnesium and unavoidable impurities, based on 100 parts by weight of a magnesium alloy, wherein the magnesium alloy has increased Fe solu-
(Continued)

bility and reduced corrosion while providing excellent mechanical properties and corrosion resistance, and a method for producing the same. The magnesium alloy of the present invention can improve the corrosion resistance of the magnesium alloy by using scandium which can simultaneously prevent from microgalvanic corrosion between a substrate and impurities without deteriorating mechanical properties and improve the passivation property of the coating formed on the surface.

11 Claims, 15 Drawing Sheets

(51) Int. Cl.

| | |
|---|---|
| ***C22C 23/04*** | (2006.01) |
| ***C22F 1/06*** | (2006.01) |
| ***C22C 23/00*** | (2006.01) |

(56) References Cited

FOREIGN PATENT DOCUMENTS

| | | | |
|---|---|---|---|
| JP | 2011-63874 | A | 3/2011 |
| JP | 2013-509217 | A | 3/2013 |
| JP | 5467294 | B2 | 4/2014 |
| KR | 0360994 | | 9/1999 |
| KR | 10-2004-0035646 | A | 4/2004 |
| KR | 10-2009-0085049 | A | 8/2009 |
| KR | 10-2010-0053480 | A | 5/2010 |
| KR | 10-2011-0031629 | A | 3/2011 |
| WO | 2013180122 | A1 | 12/2013 |
| WO | 2016-130426 | A1 | 8/2016 |

OTHER PUBLICATIONS

Japanese Office Action dated Jun. 11, 2019 in connection with counterpart Japanese Patent Application No. 2018-531123, citing the above references.

European Search Report dated Sep. 27, 2018 in connection with counterpart European Patent Application No. 16881972.0, citing the above references.

European Search Report dated Feb. 15, 2019 in connection with counterpart European Patent Application No. 16881972.0, citing the above references.

European Search Report dated Mar. 5, 2019 in connection with counterpart European Patent Application No. 16881972.0, citing the above references.

A.X. Amal Rebin et al., Influence of Scandium on Magnesium and its structure-property correlation, Materials Science Forum, Jan. 1, 2014, vol. 710, p. 132-136, Trans Tech Publications, Switzerland.

Wangyu Hu et al., Calculation of thermodynamic properties of Mg—Re (Re = Sc, Y, Pr, Nd, Gd, Tb, Dy, Ho or Er) alloys by an analytic modified embedded atom method, Journal of Physics D: Applied Physics, Dec. 24, 1999, p. 711-718, Changsha, China.

Xiao, D.H. et al., "Characterization and preparation of Mg—Al—Zn alloys with minor Sc," Journal of Alloys and Compounds, 484, 2009, 416-421.

International Search report dated Apr. 11, 2017, issued in corresponding International Application No. PCT/KR2016/013959, citing the above reference(s).

Xu et al., "Effects of heat treatment on microstructure and microhardness of Mg—3Sn—1Y alloy," The Chinese Journal of Nonferrous Metals, Jan. 2013, p. 9-14, vol. 23, No. 1, China Academic Journal Electronic Publishing House, Xi'an, China.

Chinese Office Action dated Aug. 5, 2019, in connection with counterpart Chinese Patent Application No. 201680074714.4, citing the above references.

* cited by examiner

*Pure Mg* *Mg-0.5Sc* *Mg-1.0Sc*

MAGNESIUM ALLOY HAVING EXCELLENT MECHANICAL PROPERTIES AND CORROSION RESISTANCE AND METHOD FOR MANUFACTURING THE SAME

CROSS REFERENCE TO RELATED APPLICATION

This application is a national stage application of PCT/KR2016/013959, filed on Nov. 30, 2016, which claims the benefit under 35 U.S.C. § 119(a) of Korean Patent Application No. 10-2015-0187878 filed on Dec. 28, 2015 and Korean Patent Application No. 10-2016-0161445 filed on Nov. 30, 2016 in the Korean Intellectual Property Office, the entire disclosure of which is incorporated herein by reference for all purposes.

BACKGROUND

1. Technical Field

The present invention relates to a magnesium alloy having excellent mechanical properties and corrosion resistance, and a method for manufacturing the magnesium alloy, and more particularly to a magnesium alloy having improved corrosion resistance without deteriorating mechanical properties and a method for manufacturing the same.

2. Description of Related Art

Magnesium (Mg), a lightweight metal or an alloy containing magnesium as a main component is excellent in specific strength, dimensional stability, machinability and damping capacity and is thus widely used in transportation devices such as automobiles, railways, aircrafts, ships, and the like, home appliances, medical devices, and household goods, etc., which are required to be lightweight and biodegradable. Therefore, it is attracting attention as the core material of the industry.

However, magnesium has low corrosion resistance due to strong chemical activity.

Methods of reducing an impurity content have been applied through various refining processes in order to minimize adverse effects on the corrosion resistance of the magnesium alloy associated with impurities such as Fe, Ni, Cu and/or the like.

However, when considering from the economic point of view, there is a limitation in control of the impurity content through refining, and it is thus difficult to improve the corrosion resistance to a certain level or more.

Korean Patent No. 0360994 describes an example of a method for improving the corrosion resistance of an aluminum-containing magnesium alloy produced by a die casting method, wherein corrosion resistance is improved by changing heat treatment conditions.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

An object of the present invention is to provide a magnesium alloy having improved corrosion resistance without deteriorating mechanical properties.

Another object of the present invention is to provide a method for economically producing a magnesium alloy having improved corrosion resistance without deteriorating mechanical properties.

Other objects and advantages of the present invention will become more apparent from the following detailed description of the invention, claims and drawings.

According to an aspect of the present invention, there is provided a magnesium alloy with excellent mechanical properties and corrosion resistance, the magnesium alloy comprising scandium in an amount of 0.001 parts by weight to 1.0 parts by weight and the balance being magnesium and inevitable impurities, based on 100 parts by weight of the magnesium alloy, wherein Fe solubility is increased and corrosion is reduced.

According to an embodiment of the present invention, the scandium may be included in a range of 0.05 parts by weight to 0.5 parts by weight.

According to an embodiment of the present invention, the magnesium alloy may have a corrosion rate of 0.5 mm/y or less when immersed in 3.5 wt % salt water for 72 hours.

According to an embodiment of the present invention, the magnesium alloy may have a yield strength of 80 to 120 MPa, a tensile strength of 160 to 180 MPa, and an elongation of 6 to 13%.

According to an embodiment of the present invention, the magnesium alloy may further include 0.001 to 0.007 parts by weight of iron; 0.001 to 0.002 parts by weight of silicon; 0.005 to 0.015 parts by weight of calcium; and 0.003 to 0.012 parts by weight of manganese with respect to 100 parts by weight of the magnesium alloy.

According to an embodiment of the present invention, the magnesium alloy may further include 0.5 to 7.0 parts by weight of zinc with respect to 100 parts by weight of the magnesium alloy.

According to an embodiment of the present invention, the magnesium alloy may have a yield strength of 120 to 190 MPa, a tensile strength of 210 to 310 MPa, and an elongation of 20 to 30%.

According to an embodiment of the present invention, the magnesium alloy may further include 2.5 to 10 parts by weight of tin with respect to 100 parts by weight of the magnesium alloy.

According to an embodiment of the present invention, the magnesium alloy may have a yield strength of 130 to 280 MPa, a tensile strength of 210 to 310 MPa, and an elongation of 5 to 17%.

According to an embodiment of the present invention, the magnesium alloy may further include 2 to 10 parts by weight of aluminum with respect to 100 parts by weight of the magnesium alloy.

According to an embodiment of the present invention, the magnesium alloy may have a yield strength of 130 to 200 MPa, a tensile strength of 230 to 320 MPa, and an elongation of 10 to 25%.

According to an embodiment of the present invention, the magnesium alloy may further include an alloy selected from Mg—Zn—Al, Mg—Zn—Sn, Mg—Al—Sn, and Mg—Zn—Al—Sn.

According to another aspect of the present invention, there is provided a method for producing a magnesium alloy with excellent in mechanical properties and corrosion resistance, the method comprising: casting a magnesium alloy comprising 0.001 parts by weight to 1.0 parts by weight of scandium and the balance of magnesium and unavoidable impurities with respect to 100 parts by weight of the magnesium alloy; homogenizing the cast magnesium alloy;

and extruding the homogenized magnesium alloy after preheating, wherein Fe solubility is increased and corrosion is reduced.

According to an embodiment of the present invention, there is provided a magnesium alloy having improved corrosion resistance without deteriorating mechanical properties, and a method for producing the magnesium alloy.

According to the present invention, it is possible to improve the corrosion resistance of the magnesium alloy by adding scandium, which is capable of simultaneously preventing from microgalvanic corrosion between a substrate and an impurity without deteriorating mechanical properties, and improving the passivation property of the coating formed on the surface.

The magnesium alloy having excellent mechanical properties and corrosion resistance according to the present invention can be used in various fields requiring light weight and biodegradation characteristics such as transportation devices of automobiles, railways, airplanes and ships, home appliances, medical devices, and household goods.

The magnesium alloy having excellent mechanical properties and corrosion resistance according to the present invention can be usefully used in the medical device field of which devices are in contact with the body, such as implants of stents and plates.

BRIEF DESCRIPTION OF DRAWINGS

Hereinafter, the following description will be described with reference to embodiments illustrated in the accompanying drawings.

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1:
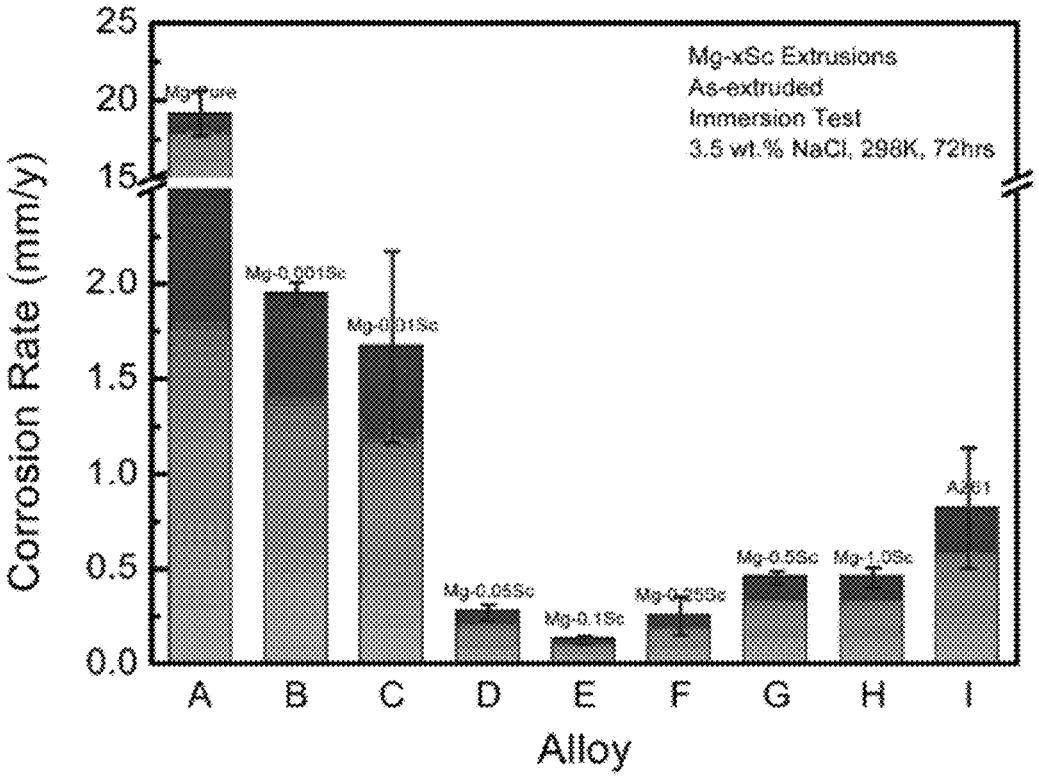
FIG. 1 is a graph illustrating corrosion rate from an immersion test based on scandium content of pure magnesium according to an embodiment of the present invention.

While the present disclosure has been described with reference to particular embodiments, it is to be appreciated that various changes and modifications may be made by those skilled in the art without departing from the spirit and scope of the present disclosure, as defined by the appended claims and their equivalents. Throughout the description of the present disclosure, when describing a certain technology is determined to evade the point of the present disclosure, the pertinent detailed description will be omitted.

While such terms as "first" and "second," etc., may be used to describe various components, such components must not be limited to the above terms. The above terms are used only to distinguish one component from another.

The terms used in the description are intended to describe certain embodiments only, and shall by no means restrict the present disclosure. Unless clearly used otherwise, expressions in the singular number include a plural meaning. In the present description, an expression such as "comprising" or "consisting of" is intended to designate a characteristic, a number, a step, an operation, an element, a part or combinations thereof, and shall not be construed to preclude any presence or possibility of one or more other characteristics, numbers, steps, operations, elements, parts or combinations thereof.

The magnesium alloy having excellent corrosion resistance and the method for producing the same according to certain embodiments of the disclosure will be described below in more detail with reference to the accompanying drawings, in which those components are rendered the same reference number that are the same or are in correspondence, regardless of the figure number, and redundant explanations are omitted.

According to an aspect of the present invention, there is provided a magnesium alloy with excellent mechanical properties and corrosion resistance comprising 0.001 parts by weight to 1.0 parts by weight of scandium and the balance of magnesium and unavoidable impurities, wherein the magnesium alloy has increased Fe solubility and reduced corrosion.

In general, to improve the corrosion resistance of magnesium alloys, methods of controlling the content of impurities or increasing the corrosion potential of the magnesium base are applied. Also, a method of continuously producing a second phase in a network form, which can serve as an obstacle to corrosion by controlling the alloy producing process, is also applied. However, these methods fail to effectively control microgalvanic corrosion between the matrix and impurities, as well as the degradation of mechanical properties.

The present invention relates to a technique to add scandium (Sc) to magnesium alloy which is able to exhibit a dual effect of preventing from microgalvanic corrosion between a matrix and an impurity without deteriorating mechanical properties and simultaneously improving the passivation properties of the coating formed on the surface.

That is, the present invention does not decrease the content of impurities existing in magnesium and the magnesium alloy by a physical or chemical method, but changes the electrochemical characteristics of impurities through addition of trace elements, and at the same time, improves corrosion resistance by improving the passivation properties of a coating.

Figure 2:
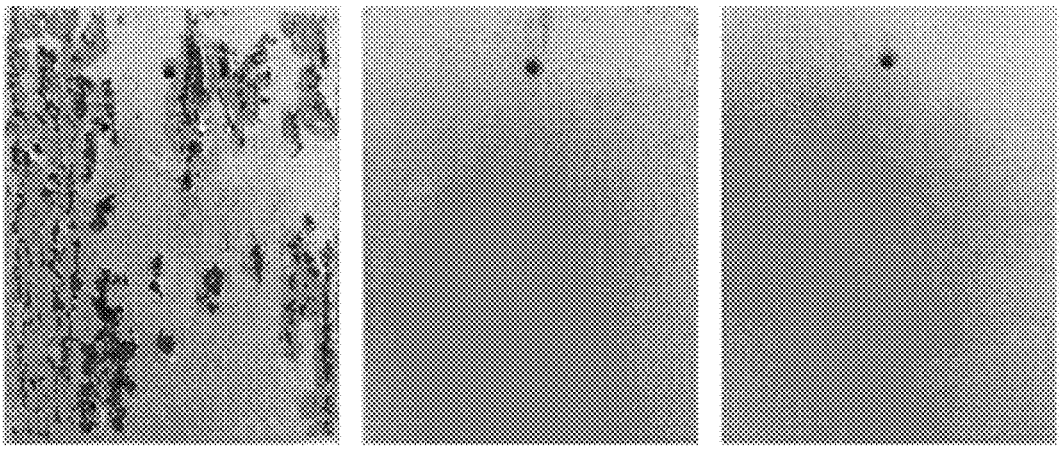
FIG. 2 is a photograph illustrating external characteristics of a magnesium alloy from an immersion test based on scandium content of pure magnesium according to an embodiment of the present invention.

FIG. 1 is a graph illustrating corrosion rate from an immersion test based on scandium content of pure magnesium according to an embodiment of the present invention. FIG. 2 is a photograph illustrating external characteristics of a magnesium alloy from an immersion test based on scandium content of pure magnesium according to an embodiment of the present invention.

As shown in FIG. 1 and FIG. 2, the corrosion resistance is remarkably improved as compared with pure magnesium.

According to the present invention, it is possible to achieve better corrosion resistance of 40% and higher than that of commercially available magnesium having a purity level of 99.9% on a commercial grade basis, and of 20% or higher than that of a high purity material (99.99% based on pure Mg, 100 times more economical of manufacturing cost compared with a commercial material.

According to an embodiment of the present invention, the scandium may be included in an amount of 0.001 parts by weight to 1.0 parts by weight, 0.05 to 0.25 parts by weight, 0.001 to 0.1 parts by weight, 0.05 to 0.5 parts by weight, or 0.05 to 0.1 parts by weight with respect to 100 parts by weight of the magnesium alloy. However, it is not limited thereto. More preferably, the scandium may be included in an amount of 0.05 to 0.5 parts by weight. When the amount of scandium is less than 0.001, the amount of scandium is too small to obtain the effect of improving the corrosion resistance. On the other hand, when the amount of scandium is more than 1.0, the corrosion may be increased.

According to an embodiment of the present invention, when immersed in 3.5 wt % brine for 72 hours, the corrosion rate may be 0.5 mm/y or less.

According to an embodiment of the present invention, a yield strength may be 80 to 120 MPa, a tensile strength may be 160 to 180 MPa, and an elongation may be 6 to 13%.

Figure 3:
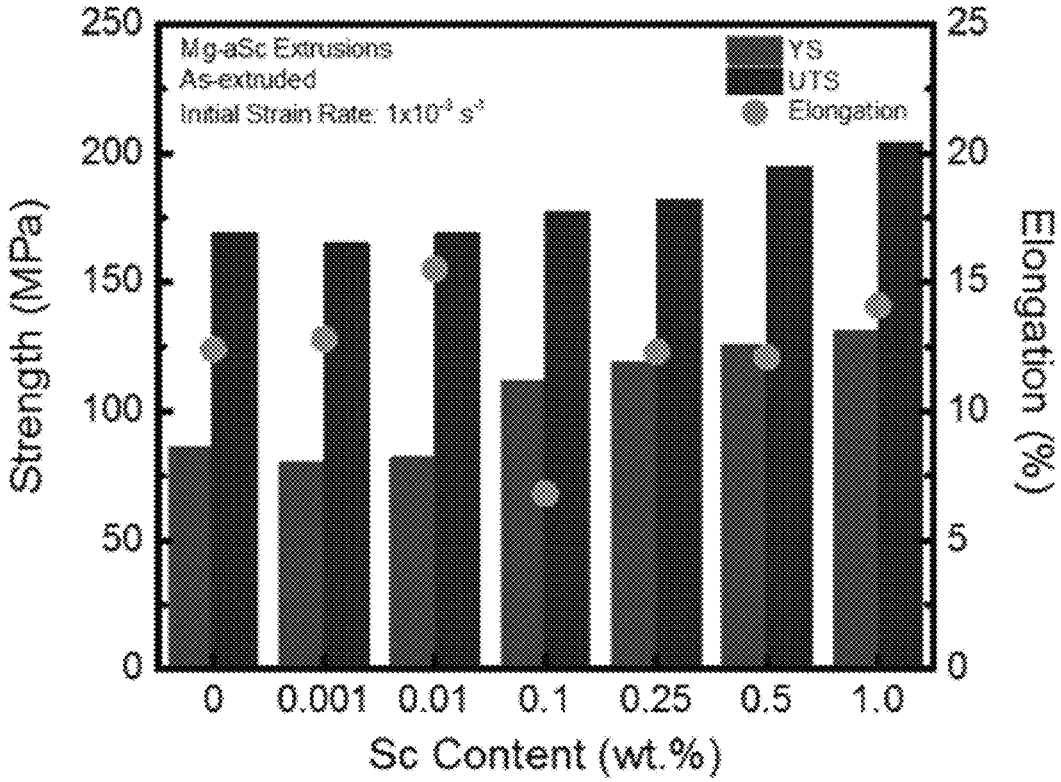
FIG. 3 is a graph illustrating mechanical properties (yield strength, tensile strength, and elongation) based on scandium content of pure magnesium according to an embodiment of the present invention.

FIG. 3 is a graph illustrating mechanical properties (yield strength, tensile strength, and elongation) based on scandium content of pure magnesium according to an embodiment of the present invention. FIG. 3 shows that the yield strength and the tensile strength increase with increasing the scandium content. This means that the mechanical strength increases as the content of scandium increases. As shown in the graph, the magnesium alloy of the present invention can improve the corrosion resistance without lowering the mechanical properties.

According to an embodiment of the present invention, the magnesium alloy may further include 0.001 to 0.007 parts by weight of iron; 0.001 to 0.002 parts by weight of silicon; 0.005 to 0.015 parts by weight of calcium; and 0.003 to 0.012 parts by weight of manganese with respect to 100 parts by weight of the magnesium alloy.

The magnesium alloy may include impurities, which are inevitably incorporated in raw materials of the alloy or in the producing process, and may include 0.001 to 0.007 parts by weight of iron and 0.001 to 0.002 parts by weight of silicon with respect to 100 parts by weight of the magnesium alloy.

Calcium contained in the magnesium alloy contributes to enhancement of the strength of the alloy due to precipitation strengthening and solid solution strengthening effects. If the calcium content is less than 0.005, the precipitation strengthening effect may be insufficient. On the other hand, if the magnesium content exceeds 0.015, calcium fraction is too high, so that the galvanic corrosion may be promoted.

The manganese contained in the magnesium alloy contributes to the improvement of the strength of the alloy due to solid solution strengthening effect and improves the corrosion resistance of the magnesium alloy by forming a compound containing manganese and impurities in the alloy. When the content of manganese is less than 0.003 parts by weight, the effect is negligible. On the other hand, when the content of manganese exceeds 0.012 parts by weight, the fraction of manganese is too high, so that the galvanic corrosion may be promoted.

According to an embodiment of the present invention, the magnesium alloy may further include 0.5 to 7.0 parts by weight of zinc with respect to 100 parts by weight of the magnesium alloy.

According to an embodiment of the present invention, the scandium may be included in an amount of 0.001 to 0.5 parts by weight, 0.05 to 0.25 parts by weight, 0.05 to 0.1 parts by weight, 0.001 to 0.25 parts by weight, 0.001 to 0.1 parts by weight or 0.01 to 0.5 parts by weight with respect to 100 parts by weight of magnesium in a magnesium-zinc alloy. However, it is not limited thereto. More preferably, the scandium may be included in an amount of 0.05 to 0.25 parts by weight parts by weight. When the content of scandium is less than 0.001, the content of scandium is too small to obtain the effect of improving the corrosion resistance. On the other hand, when the content of scandium is more than 0.5, the corrosion may be increased.

Figure 4:
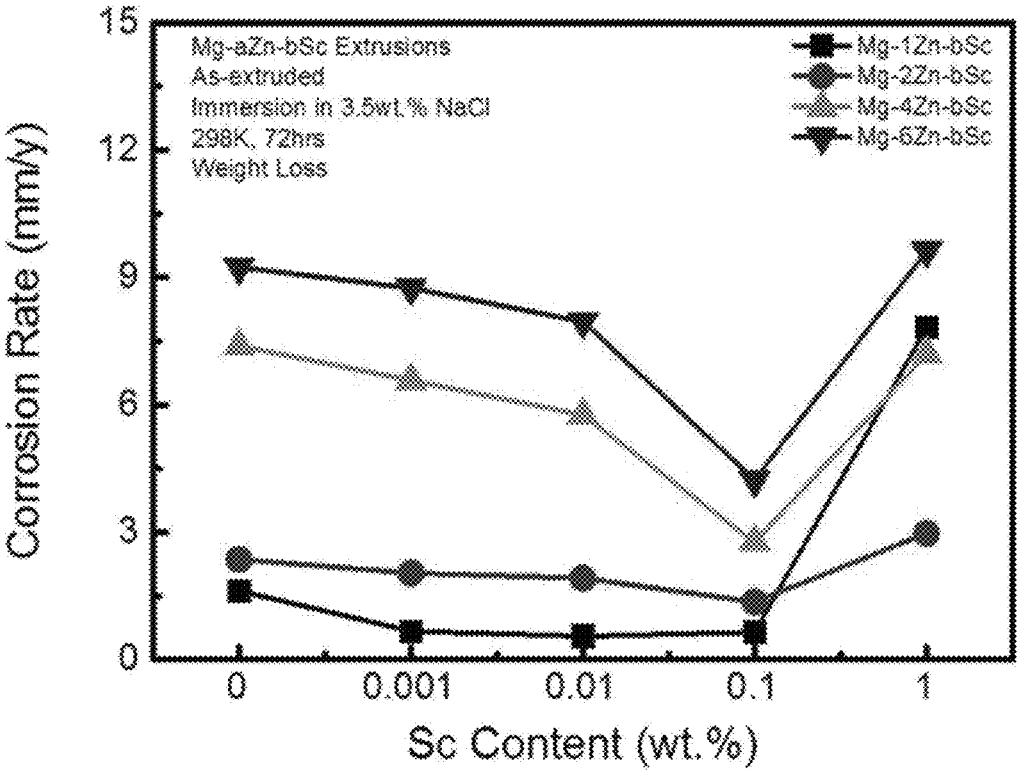
FIG. 4 is a graph illustrating corrosion rate based on scandium content of a magnesium-zinc alloy according to an embodiment of the present invention.
Figure 5:
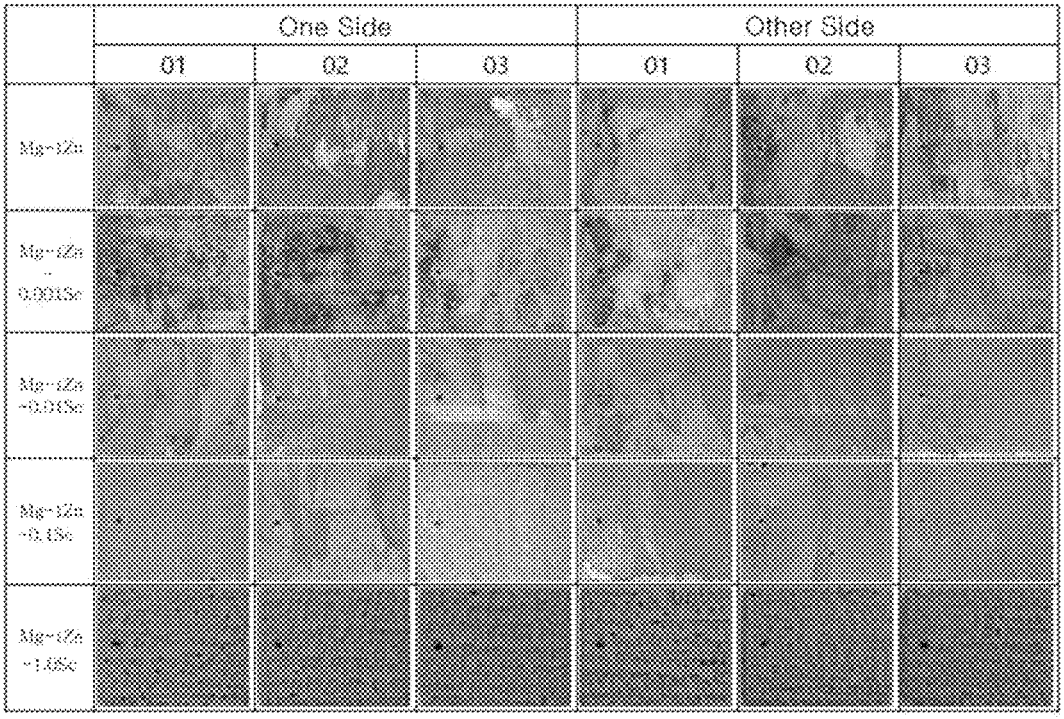
FIGS. 5, 6, 7, and 8 are photographs illustrating external characteristics of a magnesium-zinc alloy from an immersion test based on scandium content of the magnesium-zinc alloy according to an embodiment of the present invention.
Figure 6:
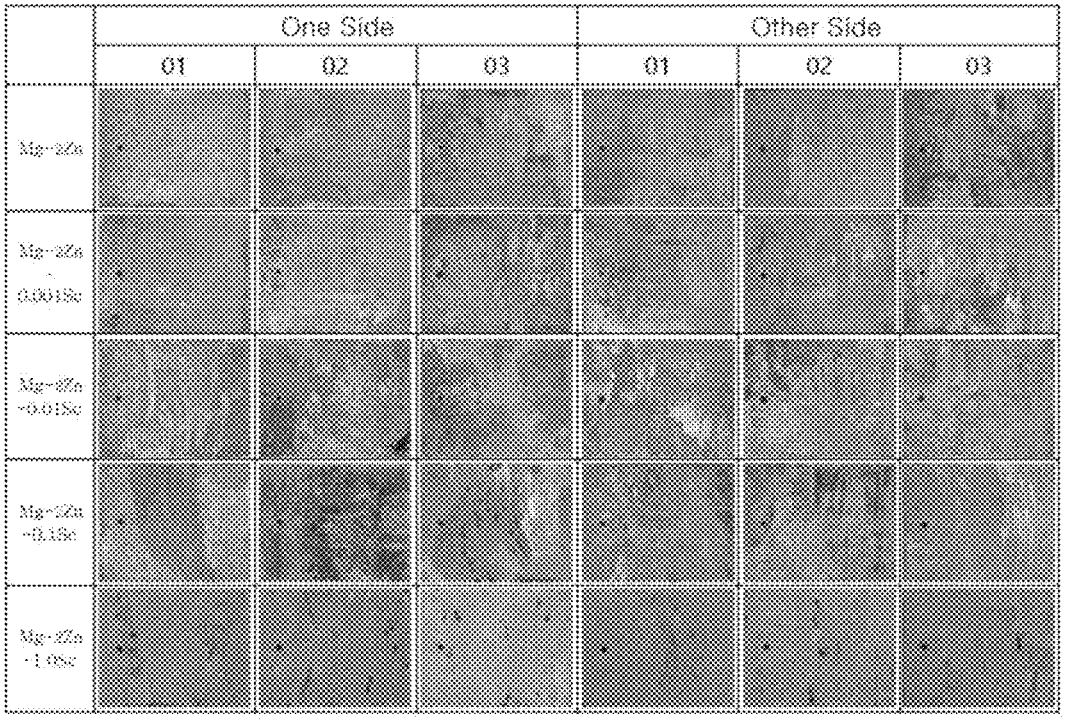
Figure 7:
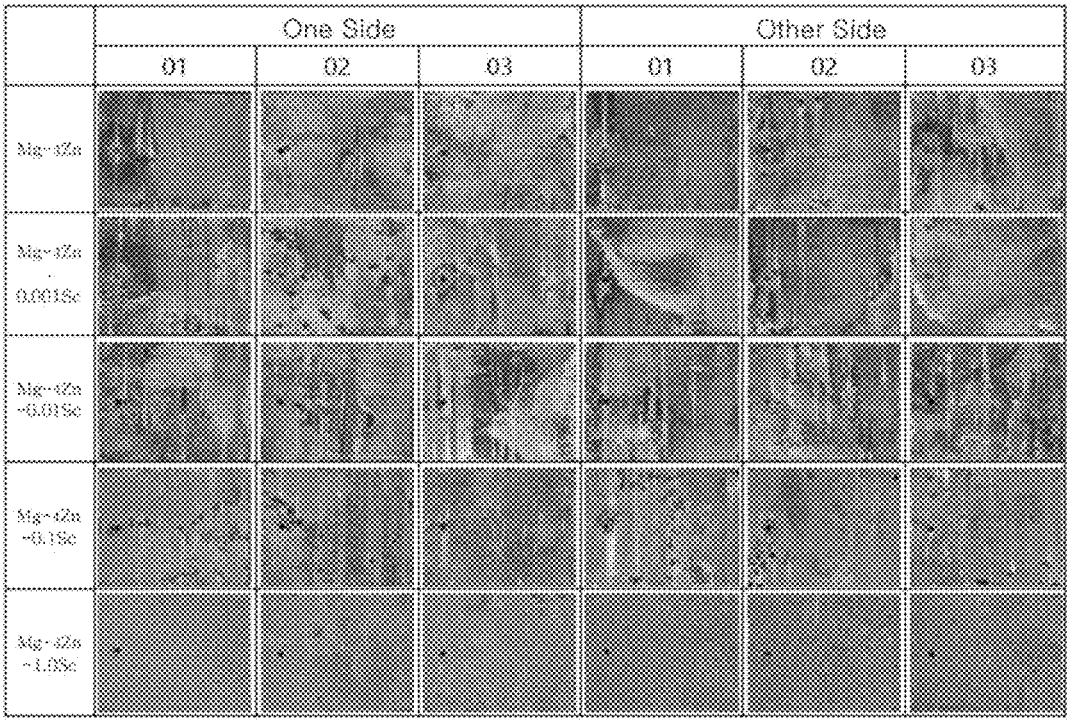
Figure 8:
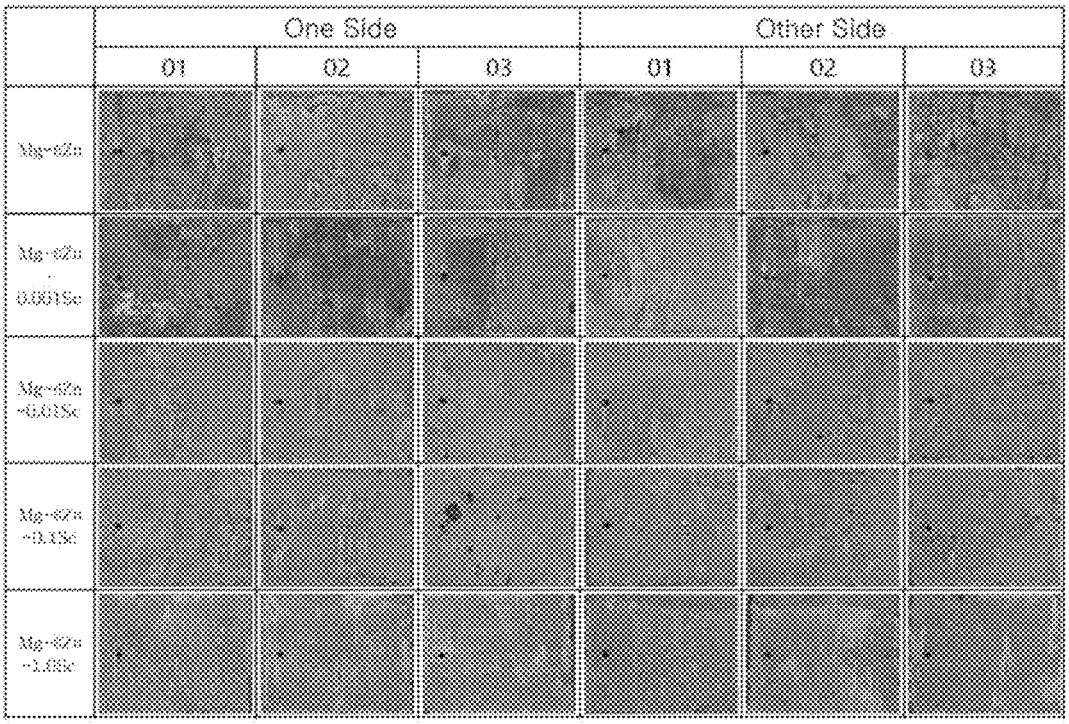
Figure 9A:
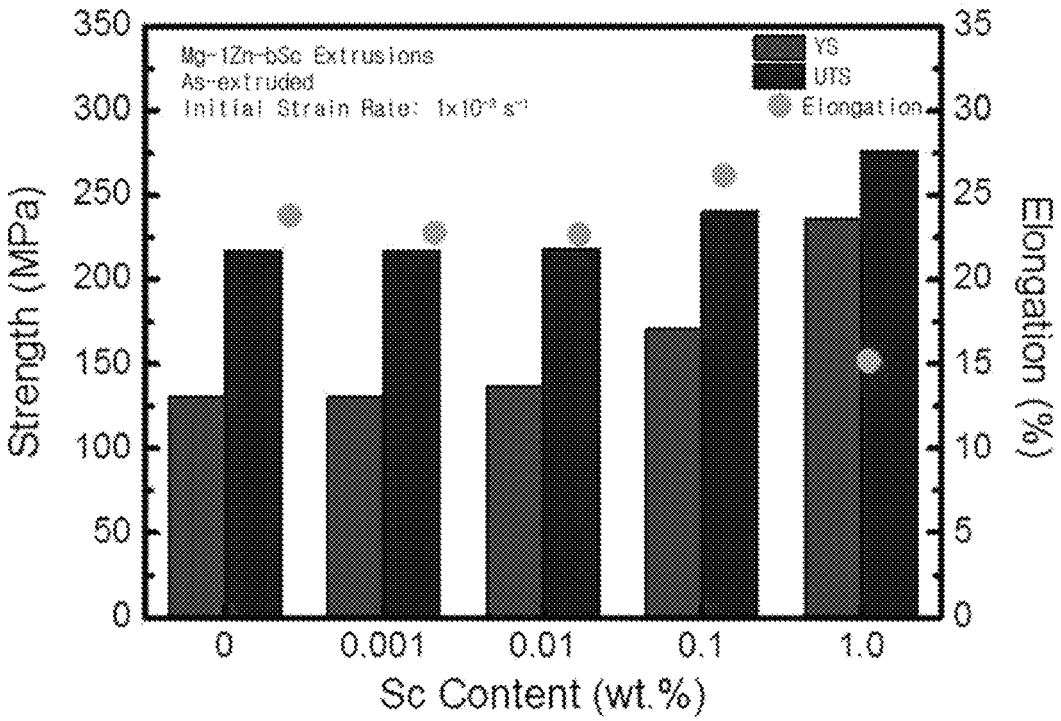
FIGS. 9A, 9B, 9C, and 9D are graphs illustrating mechanical properties (yield strength, tensile strength, and elongation) of a magnesium-zinc alloy based on scandium content of the magnesium-zinc alloy according to an embodiment of the present invention.
Figure 9B:
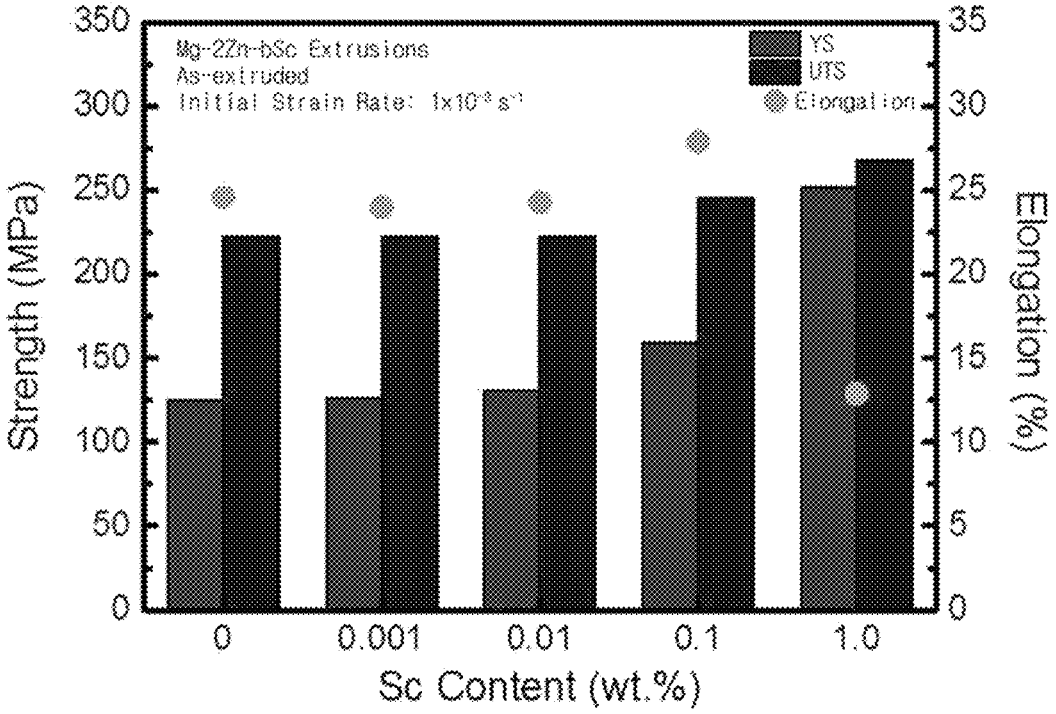
Figure 9C:
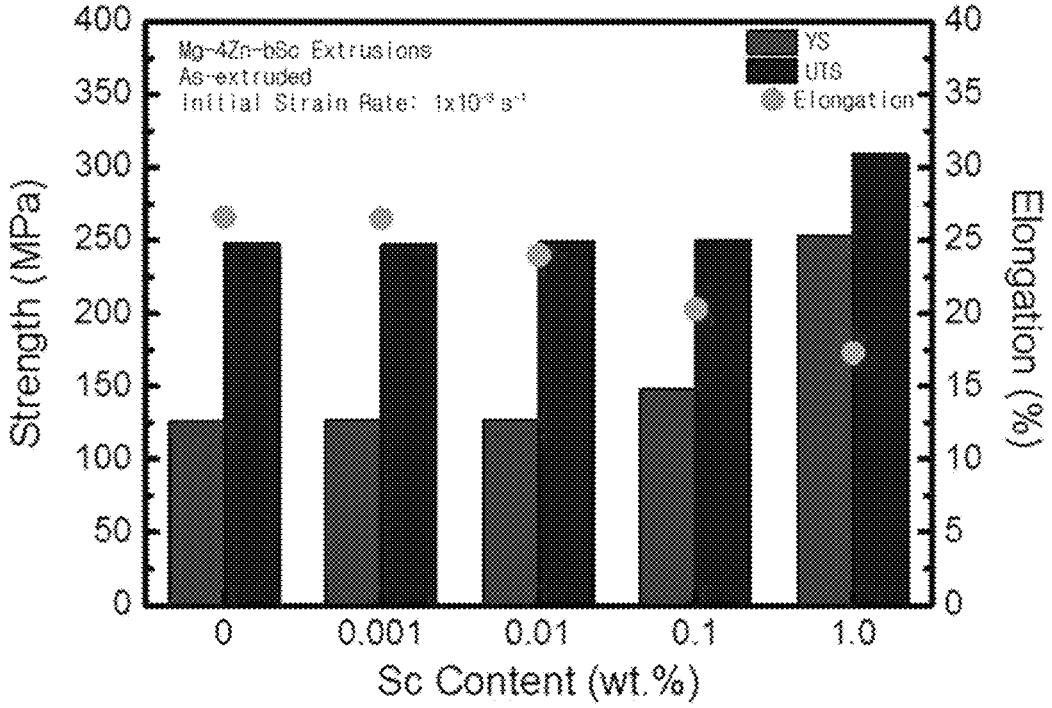
Figure 9D:
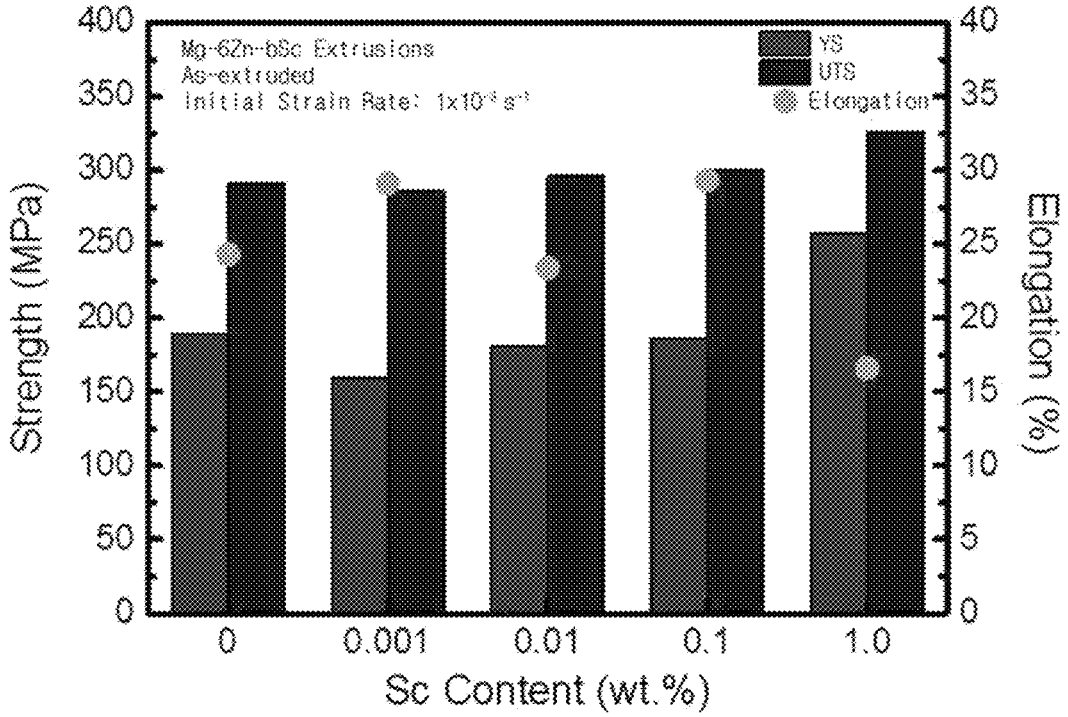

FIG. 4 is a graph illustrating corrosion rate based on scandium content of a magnesium-zinc alloy according to an embodiment of the present invention.

FIGS. 5, 6, 7, and 8 are photographs illustrating external characteristics of a magnesium-zinc alloy from an immersion test based on scandium content of the magnesium-zinc alloy according to an embodiment of the present invention.

According to FIGS. 4, 5, 6, 7, and 8, it is noted that the corrosion rate of the magnesium-zinc alloy increases with the increase of the zinc content, and the corrosion rate decreases when 0.001 parts by weight to 0.5 parts by weight of scandium is included for 100 parts by weight of the magnesium alloy, regardless of the zinc content.

According to an embodiment of the present invention, a yield strength may be 120 to 190 MPa, a tensile strength may be 210 to 310 MPa, and an elongation may be 20 to 30%.

FIGS. 9A, 9B, 9C, and 9D are graphs illustrating mechanical properties (yield strength, tensile strength, and elongation) of a magnesium-zinc alloy based on scandium content of the magnesium-zinc alloy according to an embodiment of the present invention.

According to FIGS. 9A, 9B, 9C, and 9D, the yield strength and the tensile strength increase as the content of scandium increases, regardless of the content of zinc. In addition, when the zinc content is less than 2 parts by weight with respect to 100 parts by weight of the magnesium alloy, the elongation also increases as the content of scandium increases.

Therefore, the magnesium alloy of the present invention can simultaneously improve the mechanical properties and the corrosion resistance.

According to an embodiment of the present invention, the magnesium alloy may further include 2.5 to 10 parts by weight of tin with respect to 100 parts by weight of the magnesium alloy.

According to an embodiment of the present invention, the scandium may be included in an amount of 0.001 to 0.5 parts by weight, 0.05 to 0.25 parts by weight, 0.05 to 0.1 parts by weight, 0.001 to 0.1 parts by weight, 0.001 to 0.25 parts by weight, or 0.01 to 0.5 parts by weight with respect to 100 parts by weight of magnesium in a magnesium-tin alloy. However, it is not limited thereto. More preferably, the scandium may be included in an amount of 0.05 to 0.1 parts by weight. When the amount of scandium is less than 0.001, the amount of scandium is too small to obtain the effect of improving the corrosion resistance. On the other hand, when the amount of scandium is more than 0.5, the corrosion may be increased.

Figure 10:
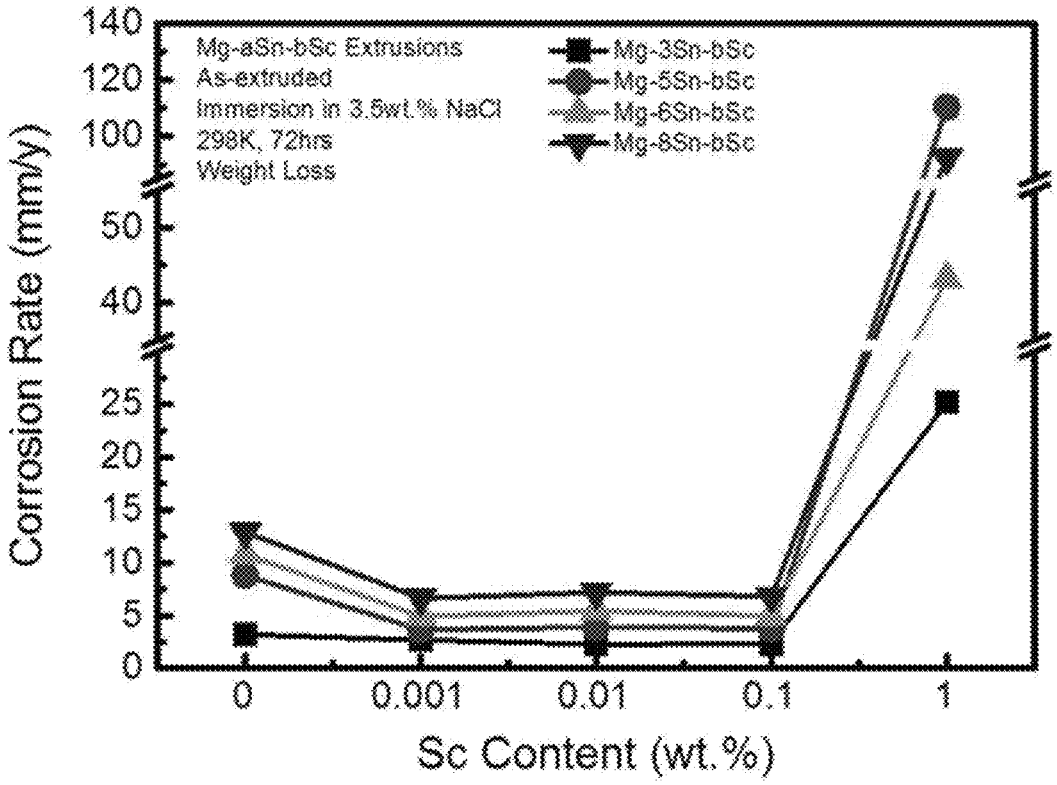
FIG. 10 is a graph illustrating corrosion rate based on scandium content of a magnesium-tin alloy according to an embodiment of the present invention.
Figure 11:
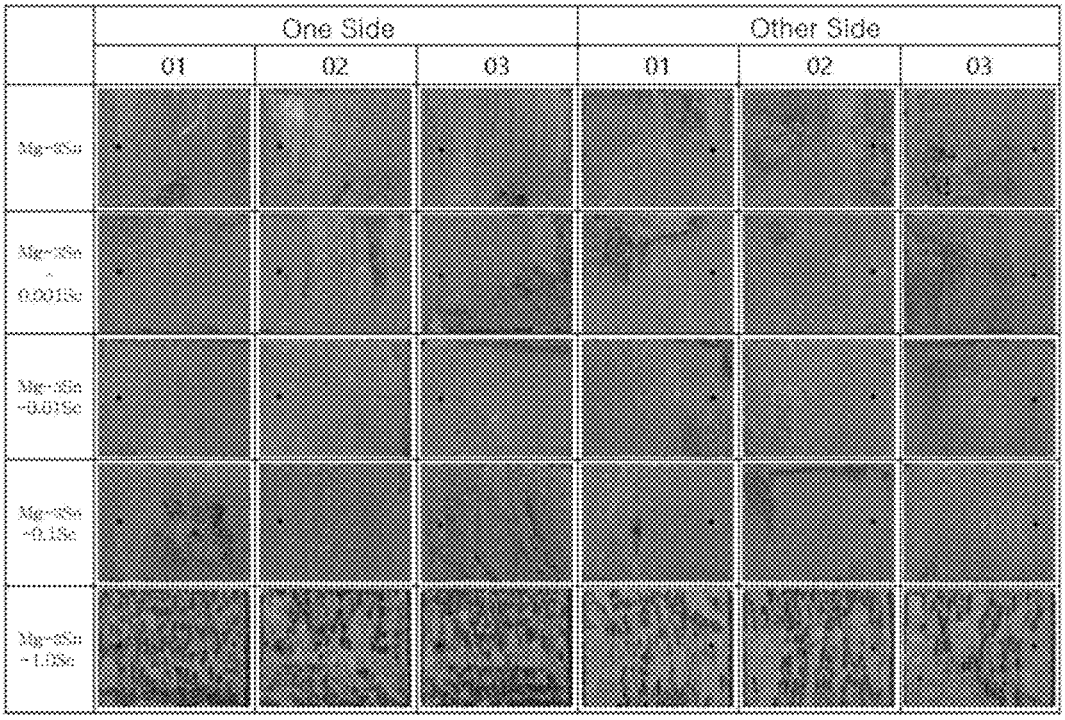
FIGS. 11, 12, 13, and 14 are photographs illustrating external characteristics of a magnesium-tin alloy from an immersion test based on scandium content of the magnesium-tin alloy according to an embodiment of the present invention.
Figure 12:
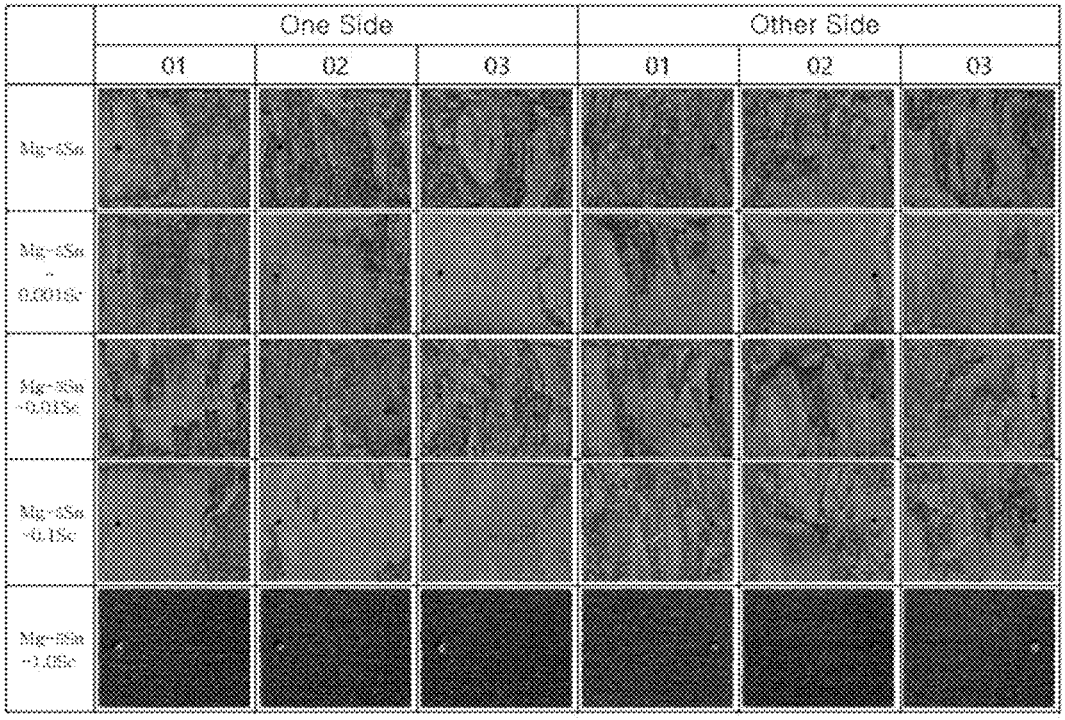
Figure 13:
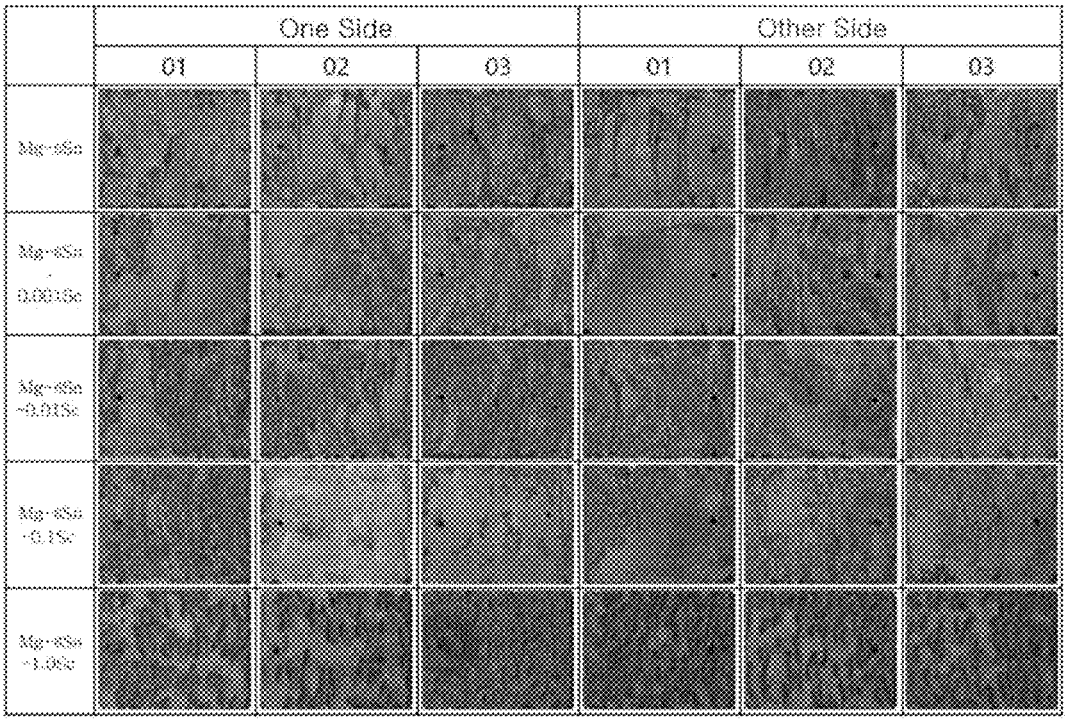
Figure 14:
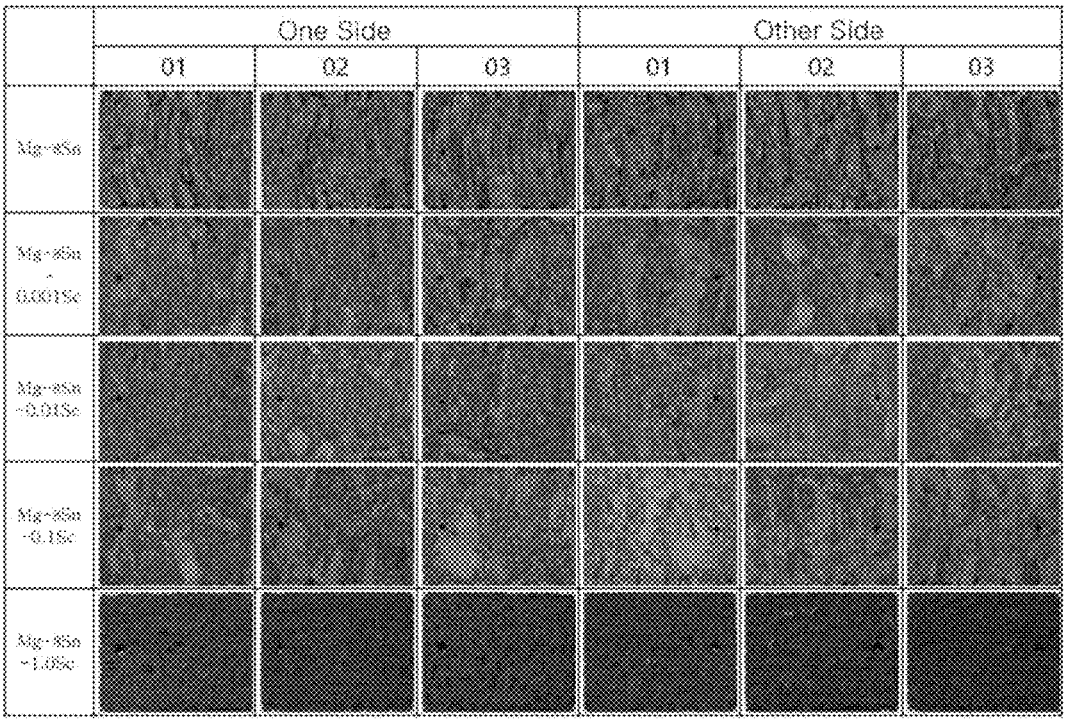
Figure 15A:
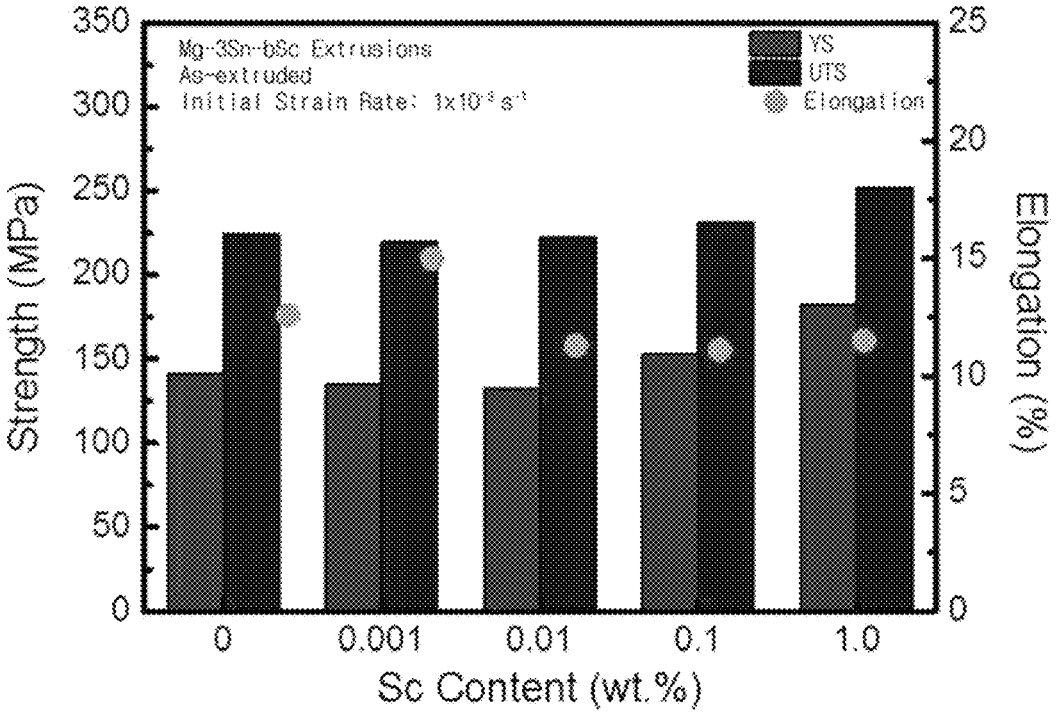
FIGS. 15A, 15B, 15C, and 15D are graphs illustrating mechanical properties (yield strength, tensile strength, and elongation) of a magnesium-tin alloy based on scandium content of the magnesium-tin alloy according to an embodiment of the present invention.
Figure 15B:
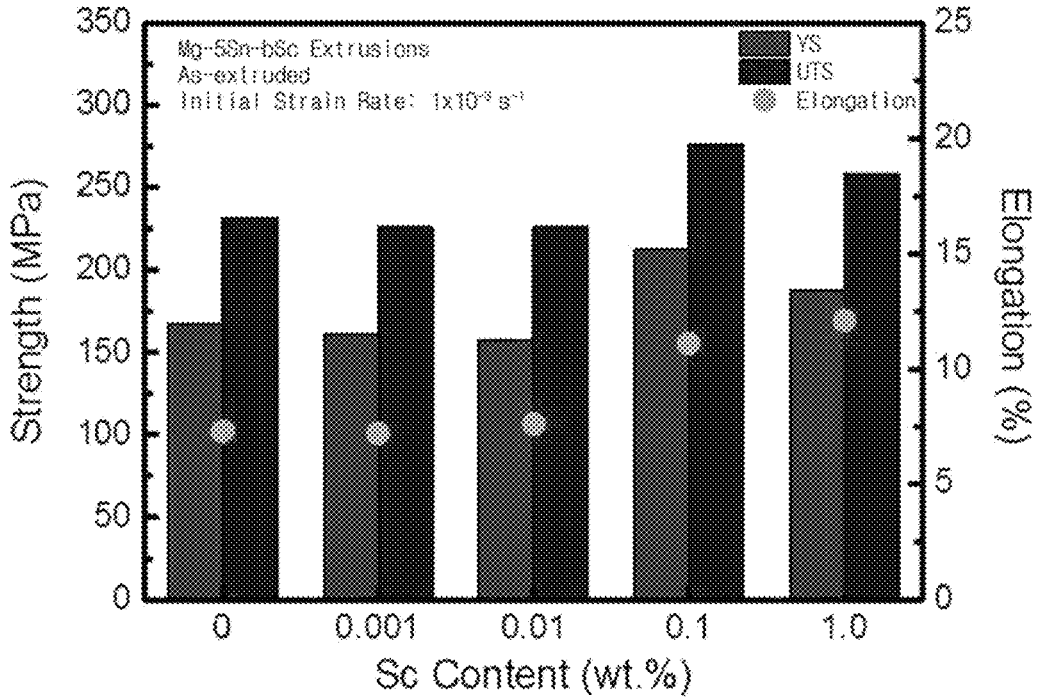
Figure 15C:
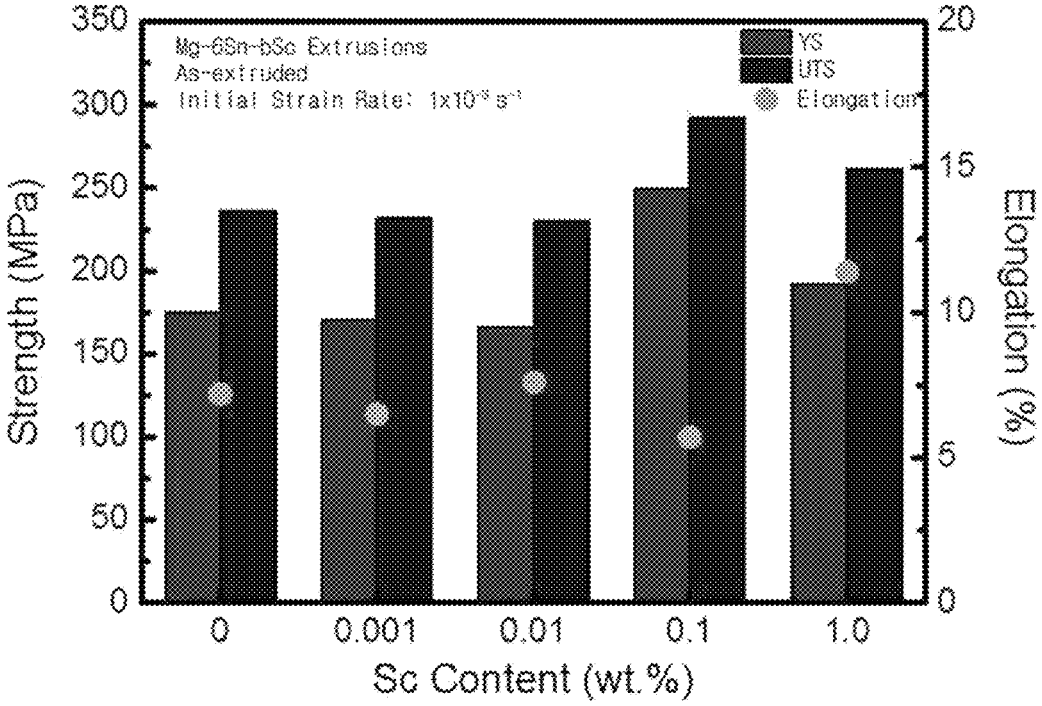
Figure 15D:
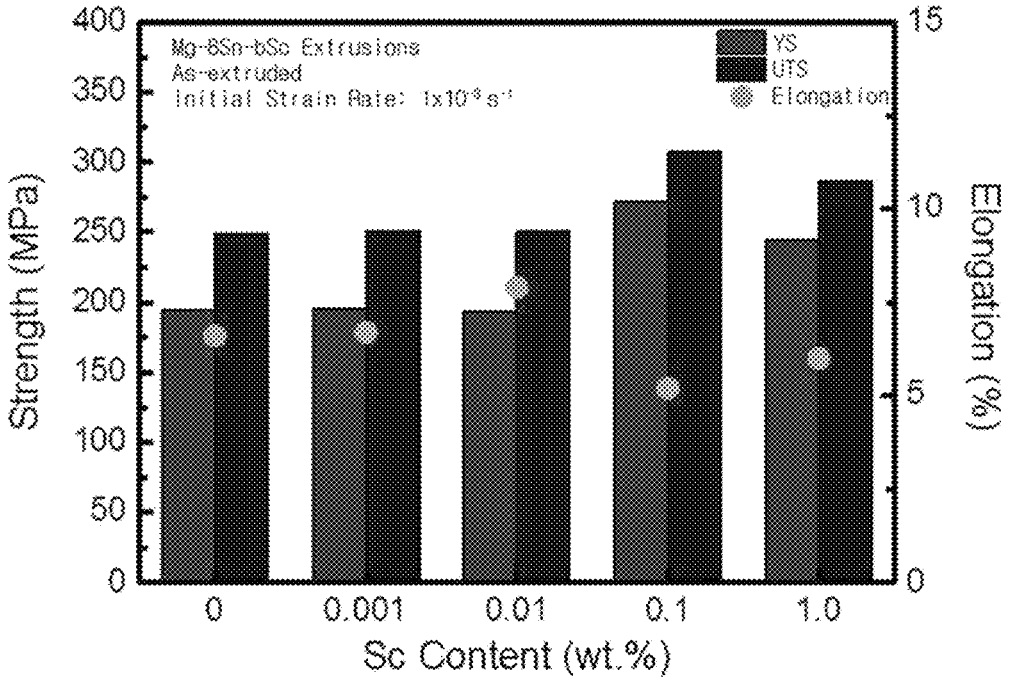

FIG. 10 is a graph illustrating corrosion rate based on scandium content of a magnesium-tin alloy according to an embodiment of the present invention.

FIGS. 11, 12, 13, and 14 are photographs illustrating external characteristics of a magnesium-tin alloy after an immersion test based on scandium content of the magnesium-tin alloy according to an embodiment of the present invention.

According to FIGS. 10, 11, 12, 13, and 14, the corrosion rate of the magnesium-tin alloy increases with increasing the tin content. The corrosion rate decreases when 0.001 to 0.5 parts by weight of scandium is included, regardless of the tin content.

According to an embodiment of the present invention, a yield strength may be 130 to 280 MPa, a tensile strength may be 210 to 310 MPa, and an elongation may be 5 to 17%.

FIGS. 15A, 15B, 15C, and 15D are graphs illustrating mechanical properties (yield strength, tensile strength, and elongation) of a magnesium-tin alloy based on scandium content of the magnesium-tin alloy according to an embodiment of the present invention.

According to FIGS. 15A, 15B, 15C, and 15D, the yield strength and the tensile strength increase as the content of scandium increases from 0.001 to 0.25 parts by weight, regardless of the content of tin. Therefore, the magnesium alloy of the present invention can simultaneously improve the mechanical properties and the corrosion resistance.

According to an embodiment of the present invention, the magnesium alloy may further include 2 to 10 parts by weight of aluminum with respect to 100 parts by weight of the magnesium alloy.

According to an embodiment of the present invention, the scandium may be included in an amount of 0.001 to 1.0 parts by weight, 0.05 to 1.0 parts by weight, 0.001 to 0.5 parts by weight, or 0.01 to 1.0 parts by weight with respect to 100 parts by weight of magnesium in a magnesium-aluminum alloy. However, it is not limited thereto. More preferably, the scandium may be included in an amount of 0.05 to 1.0 parts by weight. When the amount of scandium is less than 0.001, the amount of scandium is too small to obtain the effect of improving the corrosion resistance. On the other hand, when the amount of scandium is more than 1.0, the corrosion may be increased.

Figure 16:
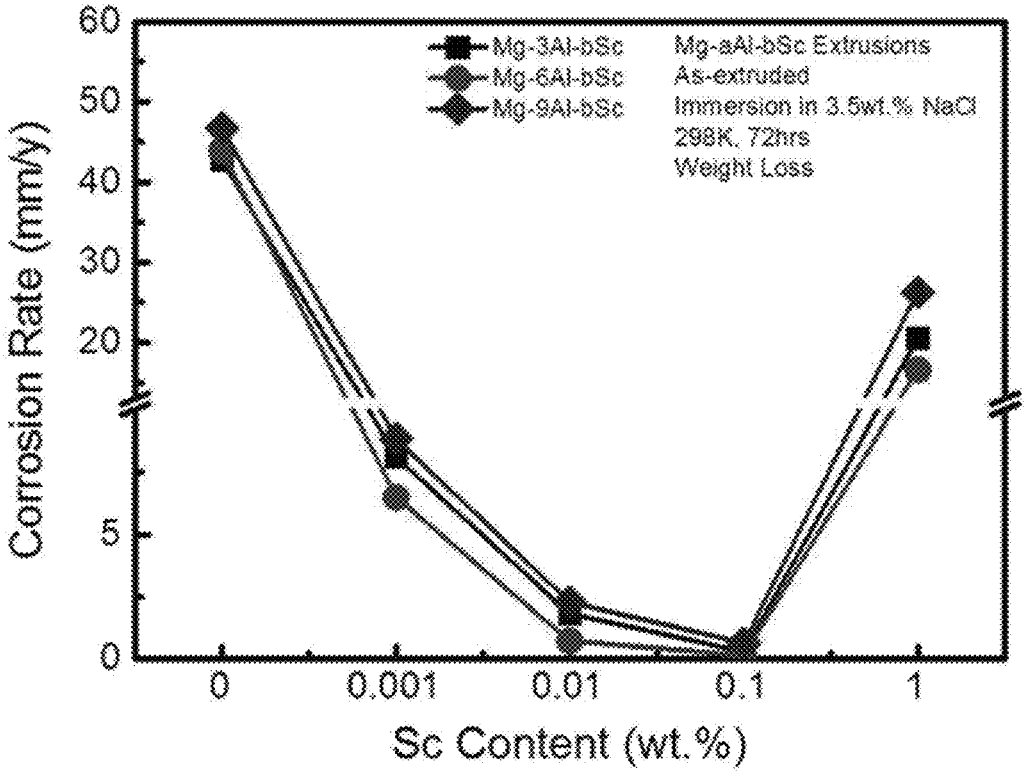
FIG. 16 is a graph illustrating corrosion rate based on scandium content of a magnesium-aluminum alloy according to an embodiment of the present invention.

FIG. 16 is a graph illustrating corrosion rate based on scandium content of a magnesium-aluminum alloy according to an embodiment of the present invention.

Figure 17:
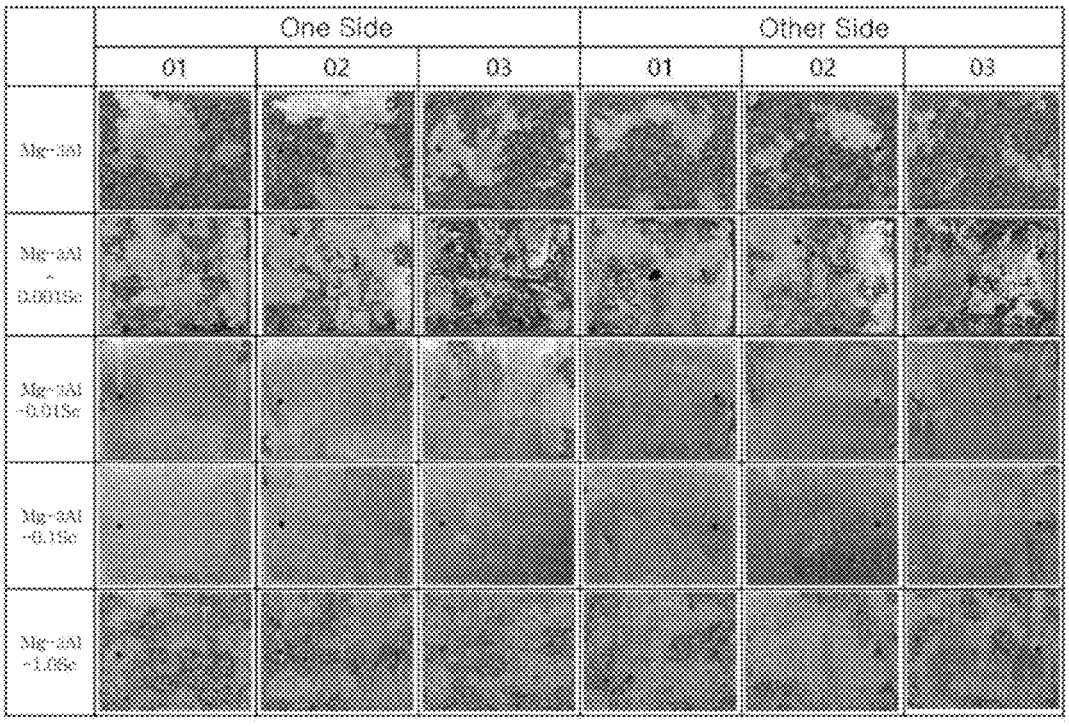
FIGS. 17, 18, and 19 are graphs illustrating external characteristics of a magnesium-aluminum alloy from an immersion test based on scandium content of the magnesium-aluminum alloy according to an embodiment of the present invention.
Figure 18:
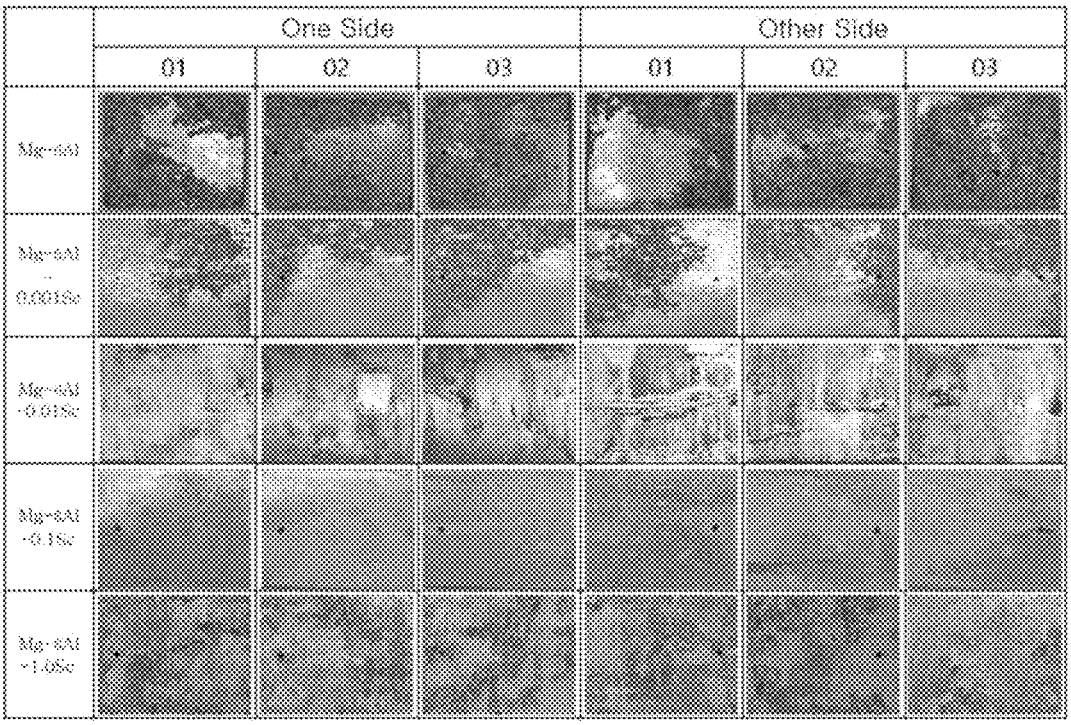
Figure 19:
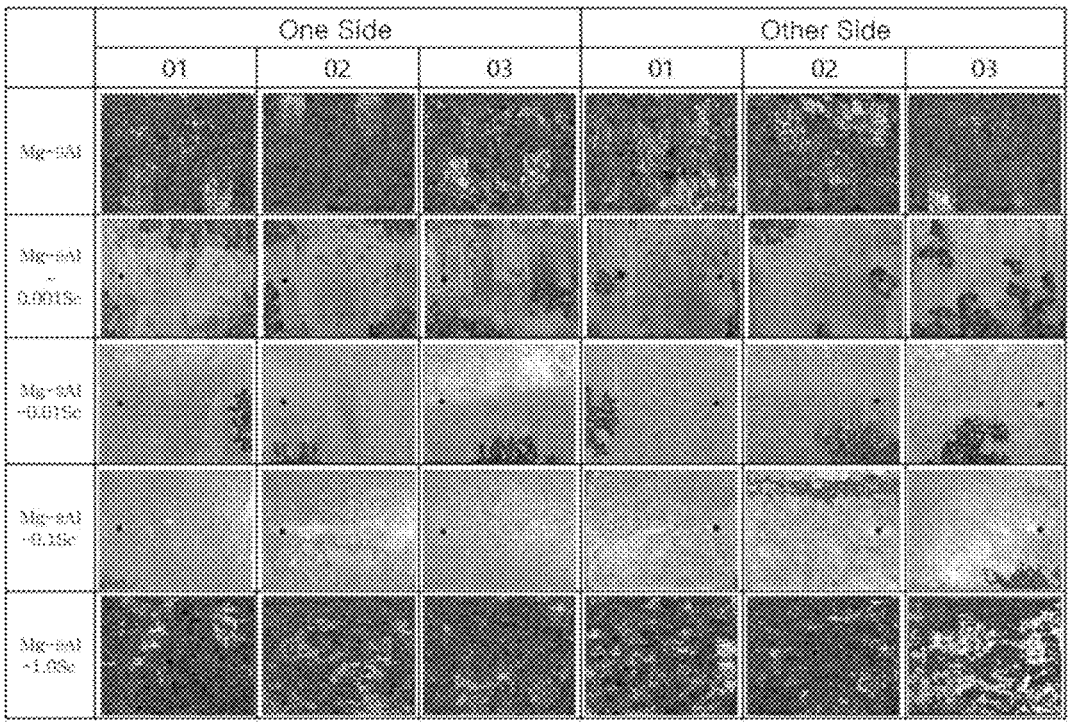

FIGS. 17, 18, and 19 are graphs illustrating external characteristics of a magnesium-aluminum alloy after an immersion test based on scandium content of the magnesium-aluminum alloy according to an embodiment of the present invention.

According to FIGS. 16, 17, 18, and 19, it is noted that the corrosion rate of the magnesium-aluminum alloy increases with the increase of the aluminum content, and the corrosion rate decreases when 0.001 parts by weight to 0.25 parts by weight of scandium is included, regardless of the aluminum content.

According to an embodiment of the present invention, the yield strength may be 130 to 200 MPa, the tensile strength may be 230 to 320 MPa, and the elongation may be 10 to 25%.

Figure 20A:
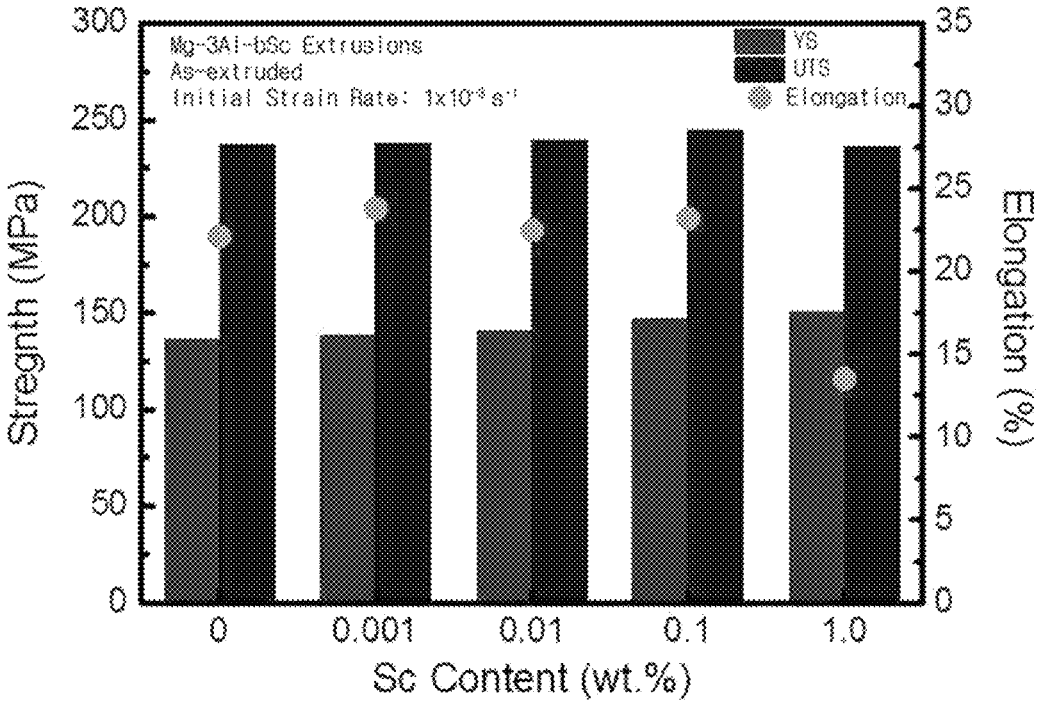
FIGS. 20A, 20B, and 20C are graphs illustrating mechanical properties (yield strength, tensile strength, and elongation) of a magnesium-aluminum alloy based on scandium of the magnesium-aluminum alloy content according to an embodiment of the present invention.
Figure 20B:
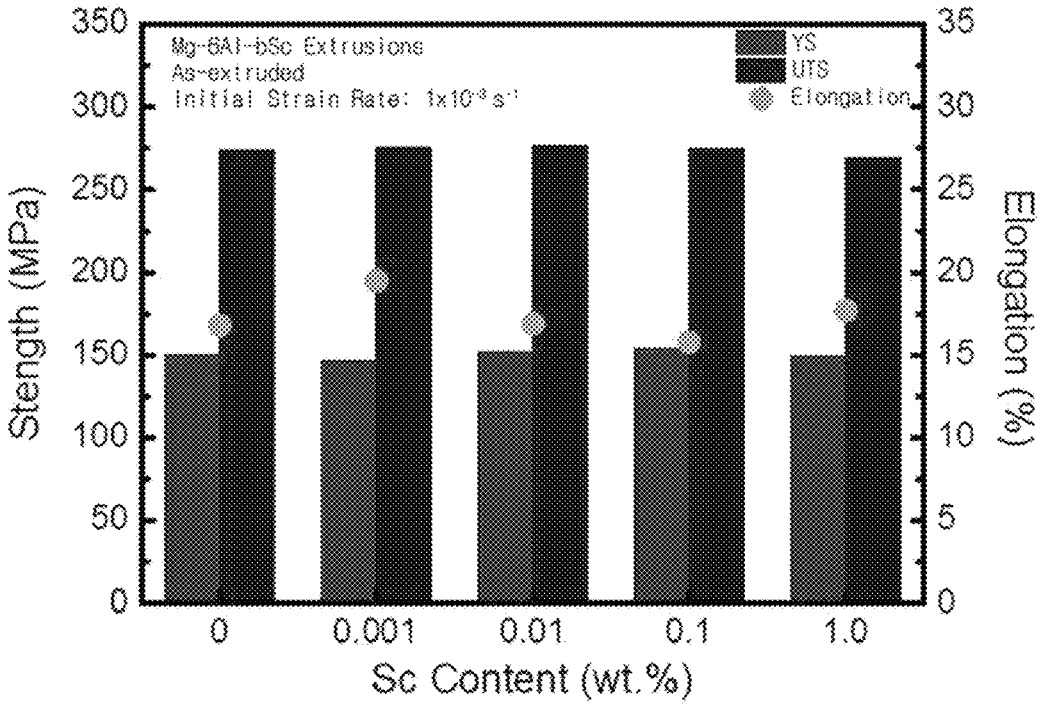
Figure 20C:
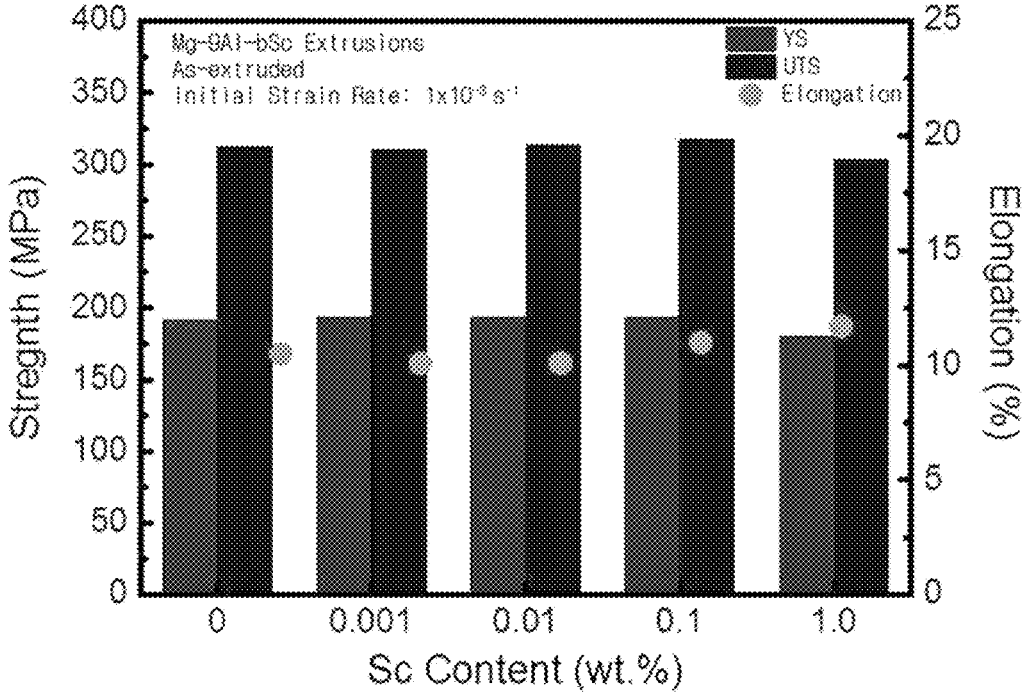

FIGS. 20A, 20B, and 20C are graphs illustrating mechanical properties (yield strength, tensile strength, and elongation) of a magnesium-aluminum alloy based on scandium content according to an embodiment of the present invention.

According to FIGS. 20A, 20B, and 20C, the yield strength and the tensile strength increase as the content of scandium increases from 0.001 to 1.0, regardless of the content of aluminum. Therefore, the magnesium alloy of the present invention can simultaneously improve the mechanical properties and the corrosion resistance.

Figure 21:
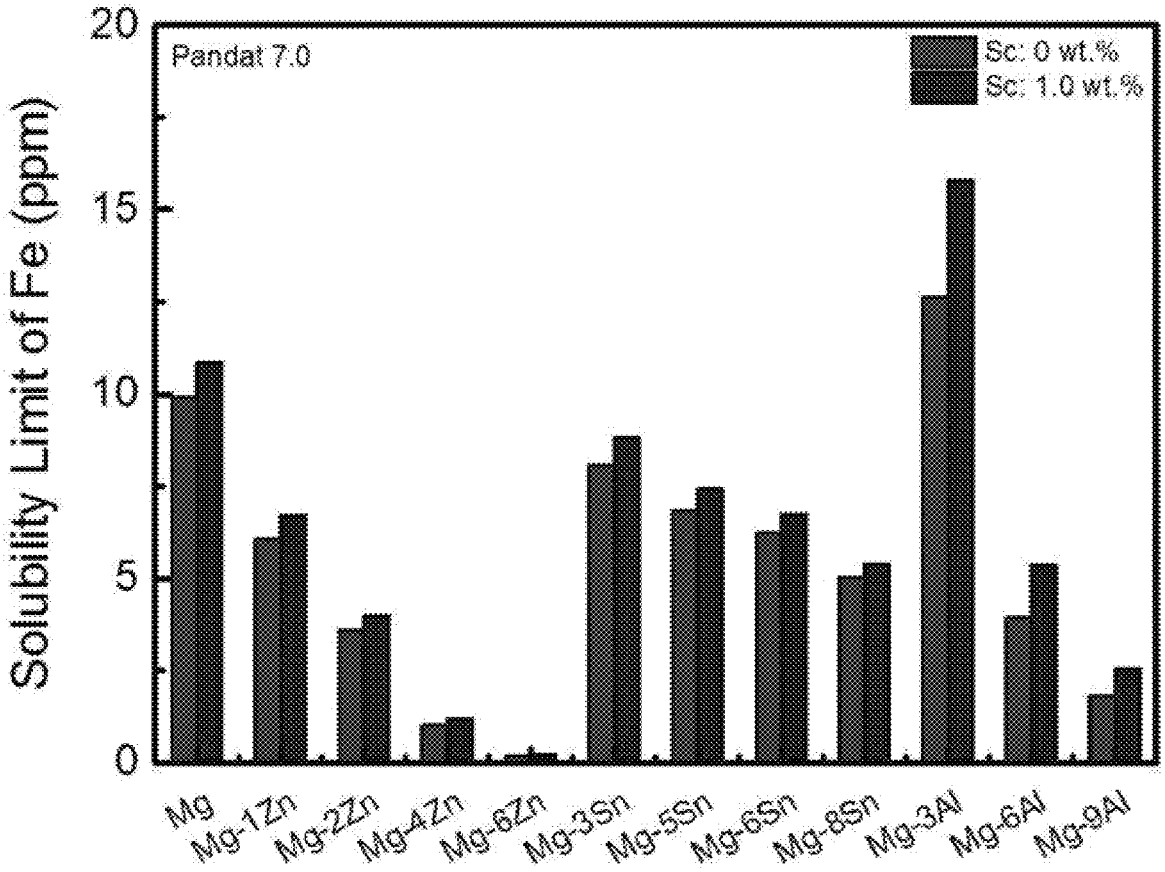
FIG. 21 is a graph illustrating the iron (Fe) solubility based on scandium content in a magnesium alloy according to an embodiment of the present invention.

FIG. 21 is a graph illustrating the iron (Fe) solubility based on scandium content in a magnesium alloy according to an embodiment of the present invention.

The Fe solubility of the present invention means the amount of the iron component that can be dissolved in the magnesium metal.

Heavy metal elements such as iron are impurities that reduce the corrosion resistance of magnesium and thus, its content is severely limited. Accordingly, the present invention provides a magnesium alloy having a high corrosion resistance and a high mechanical strength by increasing the Fe solubility in the magnesium.

According to FIG. 21, the magnesium alloy including scandium may have a relatively higher Fe solubility, regardless of the content and the type of zinc, tin, and aluminum, compared with that without scandium.

According to an embodiment of the present invention, the alloy containing scandium may be selected from Mg—Zn—Al, Mg—Zn—Sn, Mg—Al—Sn, and Mg—Zn—Al—Sn.

The magnesium alloy including scandium may have a relatively higher Fe solubility, regardless of the content and the type of one or more chosen from zinc, tin, and aluminum, compared with that without scandium.

According to another aspect of the present invention, there is provided a method for producing a magnesium alloy with excellent mechanical properties and corrosion resistance, the method comprising: casting a magnesium alloy comprising 0.001 parts by weight to 1.0 parts by weight of scandium and the balance of magnesium and unavoidable impurities with respect to 100 parts by weight of the magnesium alloy; homogenizing the cast magnesium alloy; and extruding the homogenized magnesium alloy after preheating, wherein Fe solubility is increased and corrosion is reduced.

Figure 22:
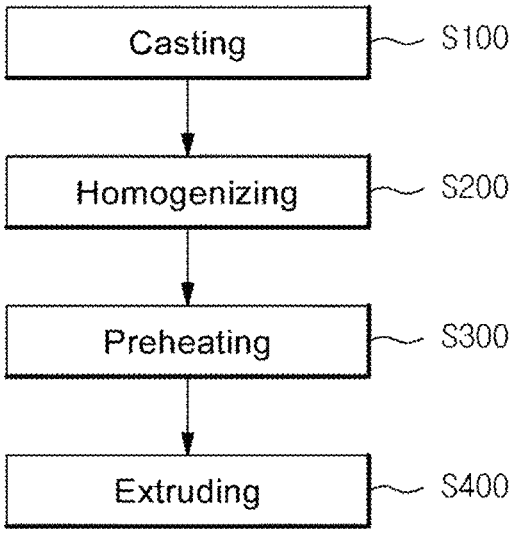
FIG. 22 is a flowchart illustrating a method of producing a magnesium alloy according to an embodiment of the present invention.

FIG. 22 is a flowchart illustrating a method of producing a magnesium alloy according to an embodiment of the present invention.

According to an embodiment of the present invention, the casting may be performed at a temperature of 650 to 800° C. However, it is not limited thereto. If the casting temperature is less than 650° C. or exceeds 800° C., casting may not be properly performed.

The casting, homogenizing and extruding steps can be accomplished by well-known techniques. For example, sand casting, sheet casting, die casting or a combination thereof may be performed. Detailed methods are described in the following examples.

Hereinafter, although more detailed descriptions will be given by examples, those are only for explanation and there is no intention to limit the disclosure.

EXAMPLES AND COMPARATIVE EXAMPLES

Preparation of a Magnesium Alloy 1

In order to prepare a magnesium alloy according to the present invention, Sc was added to pure Mg (99.9%), and Sc was added in the form of a Mg-2Sc master alloy. Here, the Mg-2Sc master alloy was added to pure Mg to be the Sc content of 0.001, 0.01, 0.05, 0.1, 0.25, 0.5, and 1.0 wt %.

The billet was cast in the form of a circular cylinder at 700° C. and homogenized at 500° C. for 24 hours.

After preheating at 350° C. for 3 hours, extrusion was performed to produce a plate-shaped extruded material having a thickness of 6 mm and a width of 28 mm.

An AZ61 alloy as a commercially available magnesium alloy was prepared to use for Comparative Example.

TABLE 1

| | [wt %] | Sc | Fe | Si | Ca | Mn | Mg |
|---|---|---|---|---|---|---|---|
| Comparative Example 1 | Mg | — | 0.002 | 0.019 | 0.006 | 0.010 | Bal. |
| Example 1 | Mg—0.001Sc | 0.001 | 0.005 | 0.001 | 0.007 | 0.005 | Bal. |
| Example 2 | Mg—0.01Sc | 0.001 | 0.005 | 0.001 | 0.007 | 0.005 | Bal. |
| Example 3 | Mg—0.1Sc | 0.050 | 0.001 | 0.010 | 0.013 | 0.007 | Bal. |
| Example 4 | Mg—0.25Sc | 0.160 | 0.001 | 0.010 | 0.010 | 0.007 | Bal. |
| Example 5 | Mg—0.5Sc | 0.300 | 0.001 | 0.011 | 0.008 | 0.007 | Bal. |
| Example 6 | Mg—1.0Sc | 0.670 | 0.003 | 0.011 | 0.008 | 0.009 | Bal. |

The prepared billets were homogenized at 500° C. for 24 hours and then machined into a cylindrical cylinder shaped billet having a diameter of 78 mm and a length of 140 to 160 mm. The thus processed billets were preheated at 350° C. for 3 hours and then extruded at a ram speed of 1.0 mm/s to provide a plate-shaped extruded material having a thickness of 6 mm and a width of 28 mm.

Preparation of a Magnesium-Zinc Alloy

In order to prepare a magnesium-zinc alloy according to the present invention, Zn and Sc were added to pure Mg (99.9%), Zn was added in the form of a pure Zn pellet having a purity of 99.9%, and Sc was added in the form of a Mg-2Sc master alloy. Here, pure Zn was added to pure Mg to be the content of Zn of 1, 2, 4 and 6 wt %, and the Mg-2Sc alloy was added to be the content of Sc of 0.001, 0.01, 0.1 and 1.0 wt %.

The composition of the magnesium-zinc alloy is shown in Table 2 below.

TABLE 2

| | [wt %] | Zn | Sc | Fe | Si | Ca | Mg |
|---|---|---|---|---|---|---|---|
| Comparative Example 2 | Mg—1Zn | 1.02 | — | 0.003 | — | 0.007 | bal. |
| Example 7 | Mg—1Zn—0.001Sc | 0.96 | 0.001 | 0.017 | — | 0.009 | bal. |
| Example 8 | Mg—1Zn—0.01Sc | 1.02 | 0.007 | 0.003 | — | 0.009 | bal. |
| Example 9 | Mg—1Zn—0.1Sc | 1.01 | 0.102 | 0.018 | — | 0.007 | bal. |
| Example 10 | Mg—1Zn—1.0Sc | 0.98 | 0.868 | 0.025 | — | 0.012 | bal. |
| Comparative Example 3 | Mg—2Zn | 1.82 | — | 0.004 | — | 0.007 | bal. |
| Example 11 | Mg—2Zn—0.001Sc | 1.86 | — | 0.007 | — | 0.019 | bal. |
| Example 12 | Mg—2Zn—0.01Sc | 2.00 | 0.007 | 0.010 | — | 0.007 | bal. |
| Example 13 | Mg—2Zn—0.1Sc | 2.12 | 0.084 | 0.063 | — | 0.007 | bal. |
| Example 14 | Mg—2Zn—1.0Sc | 2.01 | 0.844 | 0.138 | — | 0.076 | bal. |
| Comparative Example 4 | Mg—4Zn | 3.65 | — | 0.008 | 0.009 | 0.005 | bal. |
| Example 15 | Mg—4Zn—0.001Sc | 4.10 | — | 0.004 | 0.021 | 0.003 | bal. |
| Example 16 | Mg—4Zn—0.01Sc | 4.03 | 0.006 | 0.003 | — | 0.003 | bal. |
| Example 17 | Mg—4Zn—0.1Sc | 4.02 | 0.089 | 0.005 | 0.012 | 0.010 | bal. |
| Example 18 | Mg—4Zn—1.0Sc | 4.13 | 0.79 | 0.003 | 0.036 | 0.004 | bal. |
| Comparative Example 5 | Mg—6Zn | 5.59 | — | 0.009 | 0.008 | 0.004 | bal. |
| Example 19 | Mg—6Zn—0.001Sc | 5.58 | 0.001 | 0.001 | 0.042 | 0.004 | bal. |
| Example 20 | Mg—6Zn—0.01Sc | 6.23 | 0.006 | 0.004 | 0.081 | 0.007 | bal. |
| Example 21 | Mg—6Zn—0.1Sc | 6.36 | 0.089 | 0.004 | 0.053 | 0.008 | bal. |
| Example 22 | Mg—6Zn—1.0Sc | 6.29 | 0.80 | 0.009 | 0.085 | 0.007 | bal. |

The result material was charged into a carbon crucible and heated and melted to 700° C. or higher using an induction melting furnace. The molten metal was gradually cooled to 700° C. and injected at this temperature into a mold having a circular cylinder shape which is preheated to 200° C. to provide billet.

The thus-prepared billet was homogenized at 400° C. for 24 hours and then machined into a cylindrical cylinder-shaped billet having a diameter of 78 mm and a length of 140 to 160 mm. The thus processed billet was preheated at 300° C. for 3 hours and then extruded at a ram speed of 1.0 mm/s to provide a plate-shaped extruded material having a thickness of 6 mm and a width of 28 mm.

Preparation of a Magnesium-Tin Alloy

In order to prepare a magnesium-tin alloy according to the present invention, Sn and Sc were added to pure Mg (99.9%) and Sn was added in the form of a pure Sn pellet having a purity of 99.9%. Sc in the form of a Mg-2Sc master alloy was added. Here, Sn was added to pure Mg to be 3, 5, 6 and 8 wt % of Sn, and the Mg-2Sc master alloy was added to be the Sc content of 0.001, 0.01, 0.1 and 1.0 wt %.

The composition of the magnesium-tin alloy is shown in Table 3 below.

TABLE 3

| | [wt %] | Sn | Sc | Fe | Si | Ca | Mg |
|---|---|---|---|---|---|---|---|
| Comparative Example 6 | Mg—3Sn | 2.84 | — | 0.007 | 0.13 | 0.014 | bal. |
| Example 23 | Mg—3Sn—0.001Sc | 2.84 | | 0.002 | 0.02 | 0.005 | bal. |
| Example 24 | Mg—3Sn—0.01Sc | 2.76 | 0.007 | 0.001 | 0.02 | 0.006 | bal. |
| Example 25 | Mg—3Sn—0.1Sc | 2.80 | 0.08 | 0.002 | 0.02 | 0.007 | bal. |
| Example 26 | Mg—3Sn—1.0Sc | 2.86 | 0.62 | 0.002 | 0.008 | 0.008 | bal. |
| Comparative Example 7 | Mg—5Sn | 4.68 | — | 0.003 | 0.03 | 0.005 | bal. |
| Example 27 | Mg—5Sn—0.001Sc | 4.87 | — | 0.001 | 0.02 | 0.005 | bal. |
| Example 28 | Mg—5Sn—0.01Sc | 4.73 | 0.006 | 0.002 | 0.012 | 0.006 | bal. |
| Example 29 | Mg—5Sn—0.1Sc | 4.80 | 0.09 | 0.002 | 0.010 | 0.006 | bal. |
| Example 30 | Mg—5Sn—1.0Sc | 4.93 | 0.58 | 0.002 | 0.011 | 0.008 | bal. |
| Comparative Example 8 | Mg—6Sn | 5.48 | — | 0.002 | 0.02 | 0.006 | bal. |
| Example 31 | Mg—6Sn—0.001Sc | 5.77 | 0.001 | 0.003 | 0.02 | 0.006 | bal. |
| Example 32 | Mg—6Sn—0.01Sc | 5.70 | 0.009 | 0.001 | 0.005 | 0.007 | bal. |
| Example 33 | Mg—6Sn—0.1Sc | 5.82 | 0.09 | 0.003 | 0.008 | 0.008 | bal. |
| Example 34 | Mg—6Sn—1.0Sc | 4.01 | 0.25 | 0.002 | 0.001 | 0.006 | bal. |
| Comparative Example 9 | Mg—8Sn | 7.59 | — | 0.001 | 0.04 | 0.005 | bal. |
| Example 35 | Mg—8Sn—0.001Sc | 7.77 | 0.001 | 0.002 | 0.05 | 0.006 | bal. |
| Example 36 | Mg—8Sn—0.01Sc | 7.84 | — | 0.001 | 0.02 | 0.007 | bal. |
| Example 37 | Mg—SSn—0.1Sc | 7.93 | 0.09 | 0.002 | 0.011 | 0.007 | bal. |
| Example 38 | Mg—8Sn—1.0Sc | 6.97 | 0.69 | 0.037 | 0.003 | 0.004 | bal. |

The result material was charged into a carbon crucible and heated and melted to 700° C. or higher using an induction melting furnace. The molten metal was gradually cooled to 700° C. and injected at this temperature into a mold having a circular cylinder shape which is preheated to 200° C. to provide billet.

The thus-prepared billet was homogenized at 500° C. for 24 hours and then machined into a cylindrical cylinder-shaped billet having a diameter of 78 mm and a length of 140 to 160 mm. The thus processed billet was preheated at 300° C. for 3 hours and then extruded at a ram speed of 1.0 mm/s to provide a plate-shaped extruded material having a thickness of 6 mm and a width of 28 mm.

Preparation of a Magnesium-Aluminum Alloy

In order to prepare a magnesium-aluminum alloy according to the present invention, Al and Sc were added to pure Mg (99.9%), Al was added in the form of a pure Al pellet having a purity of 99.9%, and Sc was added in the form of a Mg-2Sc master alloy. Here, pure Al was added to pure Mg to be the content of Al of 3, 6, and 9 wt %, and the Mg-2Sc alloy was added to be the content of Sc of 0.001, 0.01, 0.1 and 1.0 wt %.

The composition of the magnesium-aluminum alloy is shown in Table 4 below.

TABLE 4

| | [wt %] | Al | Sc | Fe | Si | Ca | Mg |
|---|---|---|---|---|---|---|---|
| Comparative Example 10 | Mg—3Al | 2.91 | — | — | 0.10 | 0.007 | bal. |
| Example 39 | Mg—3Al—0.001Sc | 2.86 | 0.001 | — | 0.05 | 0.007 | bal. |
| Example 40 | Mg—3Al—0.01Sc | 2.88 | 0.007 | 0.002 | 0.05 | 0.016 | bal. |
| Example 41 | Mg—3Al—0.1Sc | 2.73 | 0.099 | 0.003 | 0.02 | 0.054 | bal. |
| Example 42 | Mg—3Al—1.0Sc | 2.36 | 0.24 | 0.007 | 0.05 | 0.044 | bal. |
| Comparative Example 11 | Mg—6Al | 5.85 | | 0.005 | 0.01 | 0.002 | bal. |
| Example 43 | Mg—6Al—0.001Sc | 5.55 | 0.001 | 0.003 | — | 0.004 | bal. |
| Example 44 | Mg—6Al—0.01Sc | 5.81 | 0.01 | 0.007 | 0.009 | 0.003 | bal. |
| Example 45 | Mg—6Al—0.1Sc | 5.91 | 0.07 | 0.003 | 0.004 | 0.004 | bal. |
| Example 46 | Mg—6Al—1.0Sc | 5.72 | 0.17 | 0.009 | — | 0.014 | bal. |
| Comparative Example 12 | Mg—9Al | 8.40 | — | 0.007 | 0.04 | 0.036 | bal. |
| Example 47 | Mg—9Al—0.001Sc | 8.84 | 0.001 | 0.015 | 0.05 | 0.008 | bal. |
| Example 48 | Mg—9Al—0.01Sc | 8.64 | 0.009 | 0.002 | 0.02 | 0.018 | bal. |
| Example 49 | Mg—9Al—0.1Sc | 8.78 | 0.086 | 0.001 | — | 0.009 | bal. |
| Example 50 | Mg—9Al—1.0Sc | 8.90 | 0.64 | — | — | 0.017 | bal. |

The result material was charged into a carbon crucible and heated and melted to 700° C. or higher using an induction melting furnace. The molten metal was gradually cooled to 700° C. and injected at this temperature into a mold having a circular cylinder shape which is preheated to 200° C. to provide billet.

The thus-prepared billet was homogenized at 400° C. for 24 hours and then machined into a cylindrical cylinder-shaped billet having a diameter of 78 mm and a length of 140 to 160 mm. The thus processed billet was preheated at 300° C. for 3 hours and then extruded at a ram speed of 1.0 mm/s to provide a plate-shaped extruded material having a thickness of 6 mm and a width of 28 mm.

Experimental Example 1: Corrosion Resistance Test

To evaluate the corrosion resistance of the magnesium alloy produced according to the present invention, an immersion test was carried out as follows.

A test piece was immersed in a 3.5 wt % NaCl solution (25° C.) for 72 hours, and the weight change between before and after the immersion was measured and converted into a corrosion rate.

The corrosion rate was calculated using the following equation.

$$\text{Corrosion Rate}=(K*W)/(A*T*D)$$

K=Constant

T=Exposure Time (h)

A=Range ($cm^2$)

W=Loss Mass (g)

D=Density ($g/cm^3$)

Experimental Result (1) Immersion Test

Pure magnesium has a corrosion rate of 18 mm/y, while magnesium (Mg-0.001Sc) containing 0.001 wt % of scandium has a corrosion rate of 2 mm/y, magnesium (Mg-0.01Sc) containing 0.01 wt % of scandium has a corrosion rate of 1.7 mm/y, magnesium (Mg-0.05Sc) containing 0.05 wt % of scandium has a corrosion rate of 0.25 mm/y, magnesium (Mg-0.1Sc) containing 0.1 wt % of scandium has a corrosion rate of 0.1 mm/y, magnesium (Mg-0.25Sc) containing 0.25 wt % of scandium has a corrosion rate of 0.25 mm/y, magnesium (Mg-0.5Sc) containing 0.5 wt % of scandium has a corrosion rate of 0.5 mm/y, and magnesium (Mg-1.0Sc) containing 1.0 wt % of scandium has a corrosion rate of 0.5 mm/y. AZ61 was 0.8 mm/y (see FIG. 1).

Compared with pure magnesium, the corrosion resistance was remarkably improved. Especially magnesium containing 0.05 to 1.0 wt % of scandium showed better corrosion resistance than the conventional AZ61.

The corrosion rate of a magnesium-zinc alloy containing 1 part by weight, 2 parts by weight, 4 parts by weight and 6 parts by weight of Zc was analyzed. When 0.001, 0.01 and 0.1 parts by weight of scandium was included regardless of zinc content, the corrosion rate was 8.75 mm/y or less, which was lower than the corrosion rate of the magnesium-zinc alloy (see FIG. 4). Especially, the corrosion rate was remarkably low when 0.1 parts by weight of scandium was included.

The corrosion rate of a magnesium-tin alloy including 3 parts by weight, 5 parts by weight, 6 parts by weight and 8 parts by weight of tin was analyzed. When 0.001, 0.01 and 0.1 parts by weight of scandium was included, the corrosion rate was 7.20 mm/y or less, regardless of the tin content, which was remarkably lower than the corrosion rate of the magnesium-tin alloy (see FIG. 10).

The corrosion rate of magnesium-aluminum alloy containing 3 parts by weight, 6 parts by weight and 9 parts by weight of aluminum was analyzed. When 0.001, 0.01 and 0.1 parts by weight of scandium was included, the corrosion rate was 8.84 mm/y or less, regardless of the aluminum content, which was remarkably lower than the corrosion rate of the magnesium-aluminum alloy (see FIG. 16). Especially, the corrosion rate was remarkably low when 0.1 parts by weight of scandium was included.

According to the results of the experiment, it was confirmed that magnesium including scandium exhibits the corrosion resistance superior to pure magnesium, and especially the corrosion resistance at 0.05 to 0.5 wt % of the Sc content, was much superior to that of the conventional art.

According to the present invention, it is possible to achieve better corrosion resistance of 40% and higher than that of commercially available magnesium having a purity level of 99.9% on a commercial grade basis, and 20% or higher than that of a high purity material (99.99% based on pure Mg, 100 times more economical of manufacturing cost compared with a commercial material.

(2) Test for Mechanical Properties

It was observed that the tensile strength and the yield strength were improved when 0.001, 0.01, 0.1, 1.0 parts by weight of scandium was included, compared with pure magnesium (see FIG. 3).

This is shown in Table 5 below.

TABLE 5

| | [wt %] | YS (MPa) | UTS (MPa) | EL (%) |
|---|---|---|---|---|
| Comparative Example 1 | Pure Mg | 85.7 | 169 | 12.4 |
| Example 1 | Mg—0.001Sc | 80.3 | 165 | 12.8 |
| Example 2 | Mg—0.01Sc | 81.8 | 169 | 15.5 |
| Example 3 | Mg—0.1Sc | 112.2 | 177 | 6.8 |
| Example 4 | Mg—0.25Sc | 118.7 | 182 | 12.3 |
| Example 5 | Mg—0.5Sc | 125.6 | 195 | 12.1 |
| Example 6 | Mg—1.0Sc | 131.9 | 204 | 14.1 |

In the case of a magnesium-zinc alloy, the tensile strength and yield strength were increased as the content of scandium increased regardless of the zinc content (FIG. 9).

This is shown in Table 6 below.

TABLE 6

| | [wt %] | Corr. Rate (mm/y) | YS (MPa) | UTS (MPa) | E.L. (%) |
|---|---|---|---|---|---|
| Comparative Example 2 | Mg—1Zn | 1.04 | 131 | 217 | 23.8 |
| Example 7 | Mg—1Zn—0.001Sc | 0.67 | 130 | 217 | 22.8 |
| Example 8 | Mg—1Zn—0.01Sc | 0.55 | 137 | 218 | 22.7 |
| Example 9 | Mg—1Zn—0.1Sc | 0.65 | 171 | 240 | 26.2 |
| Example 10 | Mg—1Zn—1.0Sc | 7.82 | 236 | 276 | 15.2 |
| Comparative Example 3 | Mg—2Zn | 2.36 | 126 | 223 | 24.6 |
| Example 11 | Mg—2Zn—0.001Sc | 2.04 | 126 | 223 | 24.0 |
| Example 12 | Mg—2Zn—0.01Sc | 1.92 | 131 | 223 | 24.3 |
| Example 13 | Mg—2Zn—0.1Sc | 1.36 | 159 | 246 | 27.9 |
| Example 14 | Mg—2Zn—1.0Sc | 2.98 | 252 | 268 | 12.9 |
| Comparative Example 4 | Mg—4Zn | 7.39 | 126 | 248 | 26.6 |
| Example 15 | Mg—4Zn—0.001Sc | 6.58 | 127 | 247 | 26.5 |
| Example 16 | Mg—4Zn—0.01Sc | 5.76 | 127 | 249 | 24.0 |
| Example 17 | Mg—4Zn—0.1Sc | 2.77 | 148 | 250 | 20.3 |
| Example 18 | Mg—4Zn—1.0Sc | 7.2 | 253 | 309 | 17.3 |
| Comparative Example 5 | Mg—6Zn | 9.24 | 189 | 291 | 24.3 |
| Example 19 | Mg—6Zn—0.001Sc | 8.75 | 160 | 286 | 29.1 |
| Example 20 | Mg—6Zn—0.01Sc | 7.96 | 180 | 296 | 23.4 |
| Example 21 | Mg—6Zn—0.1Sc | 4.23 | 186 | 300 | 29.3 |
| Example 22 | Mg—6Zn—1.0Sc | 9.63 | 257 | 326 | 16.6 |

In the case of a magnesium-tin alloy, the tensile strength and yield strength were increased as the content of scandium increased regardless of the tin content (FIG. 15).

This is shown in Table 7 below.

TABLE 7

| | [wt %] | Corr. Rate (mm/y) | YS (MPa) | UTS (MPa) | E.L. (%) |
|---|---|---|---|---|---|
| Comparative Example 6 | Mg—3Sn | 3.21 | 142 | 224 | 12.6 |
| Example 23 | Mg—3Sn—0.001Sc | 2.69 | 135 | 220 | 15 |
| Example 24 | Mg—3Sn—0.01Sc | 2.29 | 133 | 222 | 11.3 |
| Example 25 | Mg—3Sn—0.1Sc | 2.34 | 153 | 231 | 11.1 |
| Example 26 | Mg—3Sn—1.0Sc | 25.2 | 183 | 252 | 11.5 |
| Comparative Example 7 | Mg—5Sn | 8.8 | 167 | 231 | 7.3 |
| Example 27 | Mg—5Sn—0.001Sc | 3.68 | 161 | 226 | 7.2 |
| Example 28 | Mg—5Sn—0.01Sc | 3.91 | 158 | 226 | 7.6 |
| Example 29 | Mg—5Sn—0.1Sc | 3.79 | 212 | 276 | 11.1 |
| Example 30 | Mg—5Sn—1.0Sc | 110 | 188 | 258 | 12.1 |
| Comparative Example 8 | Mg—6Sn | 10.8 | 175 | 236 | 7.2 |
| Example 31 | Mg—6Sn—0.001Sc | 4.94 | 170 | 232 | 6.5 |
| Example 32 | Mg—6Sn—0.01Sc | 5.43 | 166 | 230 | 7.6 |

TABLE 7-continued

| | [wt %] | Corr. Rate (mm/y) | YS (MPa) | UTS (MPa) | E.L. (%) |
|---|---|---|---|---|---|
| Example 33 | Mg—6Sn—0.1Sc | 4.98 | 250 | 292 | 5.7 |
| Example 34 | Mg—6Sn—1.0Sc | 43.2 | 192 | 261 | 11.4 |
| Comparative Example 9 | Mg—8Sn | 12.9 | 194 | 249 | 6.6 |
| Example 35 | Mg—8Sn—0.001Sc | 6.64 | 195 | 251 | 6.7 |
| Example 36 | Mg—8Sn—0.01Sc | 7.20 | 194 | 251 | 7.9 |
| Example 37 | Mg—8Sn—0.1Sc | 6.84 | 272 | 307 | 5.2 |
| Example 38 | Mg—8Sn—1.0Sc | 92.5 | 244 | 286 | 6 |

In the case of magnesium-aluminum alloy, the tensile strength and yield strength were increased as the content of scandium increased regardless of an aluminum content (FIG. 20).

This is shown in Table 8 below.

TABLE 8

| | [wt %] | Corr. Rate (mm/y) | YS (MPa) | UTS (MPa) | E.L. (%) |
|---|---|---|---|---|---|
| Comparative Example 10 | Mg—3Al | 42.8 | 136 | 237 | 22.1 |
| Example 39 | Mg—3Al—0.001Sc | 8.1 | 138 | 238 | 23.8 |
| Example 40 | Mg—3Al—0.01Sc | 1.83 | 141 | 239 | 22.5 |
| Example 41 | Mg—3Al—0.1Sc | 0.3 | 147 | 245 | 23.2 |
| Example 42 | Mg—3Al—1.0Sc | 20.5 | 151 | 236 | 13.5 |
| Comparative Example 11 | Mg—6Al | 43.9 | 151 | 274 | 16.8 |
| Example 43 | Mg—6Al—0.001Sc | 6.49 | 147 | 276 | 19.5 |
| Example 44 | Mg—6Al—0.01Sc | 0.74 | 152 | 277 | 16.9 |
| Example 45 | Mg—6Al—0.1Sc | 0.15 | 154 | 275 | 15.8 |
| Example 46 | Mg—6Al—1.0Sc | 16.6 | 150 | 270 | 17.7 |
| Comparative Example 12 | Mg—9Al | 46.7 | 192 | 312 | 10.5 |
| Example 47 | Mg—9Al—0.001Sc | 8.84 | 194 | 310 | 10.1 |
| Example 48 | Mg—9Al—0.01Sc | 2.29 | 193 | 313 | 10.1 |
| Example 49 | Mg—9Al—0.1Sc | 0.64 | 193 | 317 | 11.0 |
| Example 50 | Mg—9Al—1.0Sc | 26.3 | 180 | 303 | 11.7 |

Experimental results show that magnesium including scandium exhibits excellent mechanical properties and corrosion resistance over pure magnesium. Particularly, magnesium including 0.05 to 0.5 parts by weight of scandium exhibits the corrosion resistance superior to that of conventional one. According to the present invention, it is possible to remarkably improve the corrosion resistance against magnesium that does not contain scandium.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A magnesium alloy comprising, with respect to 100 parts by weight of the magnesium alloy:

0.001 parts by weight to 1.0 parts by weight of scandium;

0.001 to 0.007 parts by weight of iron;

0.001 to 0.002 parts by weight of silicon;

0.005 to 0.015 parts by weight of calcium;

0.003 to 0.012 parts by weight of manganese; and the balance of magnesium and unavoidable impurities, wherein Fe solubility is increased and corrosion is reduced while mechanical properties and corrosion resistance are maintained.

2. The magnesium alloy of claim 1, wherein the scandium is included in a range of 0.05 parts by weight to 0.5 parts by weight.

3. The magnesium alloy of claim 1, wherein the magnesium alloy has a corrosion rate of 0.5 mm/y or less when immersed in 3.5 wt % salt water for 72 hours.

4. The magnesium alloy of claim 1, wherein the magnesium alloy has a yield strength of 80 to 120 MPa, a tensile strength of 160 to 180 MPa, and an elongation of 6 to 13%.

5. The magnesium alloy of claim 1, further comprising 0.5 to 7.0 parts by weight of zinc with respect to 100 parts by weight of the magnesium alloy.

6. The magnesium alloy of claim 5, wherein the magnesium alloy has a yield strength of 120 to 190 MPa, a tensile strength of 210 to 310 MPa, and an elongation of 20 to 30%.

7. The magnesium alloy of claim 1, further comprising 2.5 to 10 parts by weight of tin with respect to 100 parts by weight of the magnesium alloy.

8. The magnesium alloy of claim 7, wherein the magnesium alloy has a yield strength of 130 to 280 MPa, a tensile strength of 210 to 310 MPa, and an elongation of 5 to 17%.

9. The magnesium alloy of claim 1, further comprising 2 to 10 parts by weight of aluminum with respect to 100 parts by weight of the magnesium alloy.

10. The magnesium alloy of claim 9, wherein the magnesium alloy has a yield strength of 130 to 200 MPa, a tensile strength of 230 to 320 MPa, and an elongation of 10 to 25%.

11. A method for producing the magnesium alloy of claim 1, the method comprising:

casting an alloy, wherein the alloy comprises, with respect to 100 parts by weight of the alloy:

0.001 parts by weight to 1.0 parts by weight of scandium;

0.001 to 0.007 parts by weight of iron;

0.001 to 0.002 parts by weight of silicon;

0.005 to 0.015 parts by weight of calcium;

0.003 to 0.012 parts by weight of manganese; and the balance of magnesium and unavoidable impurities;

homogenizing the cast alloy; and extruding the homogenized magnesium alloy after preheating.

* * * * *